US012560364B2

(12) United States Patent
Okumura

(10) Patent No.: US 12,560,364 B2
(45) Date of Patent: Feb. 24, 2026

(54) AIR CONDITIONER AND AIR CONDITIONING SYSTEM

(71) Applicant: FUJITSU GENERAL LIMITED, Kanagawa (JP)

(72) Inventor: Satoshi Okumura, Kanagawa (JP)

(73) Assignee: FUJITSU GENERAL LIMITED, Kanagawa (JP)

( * ) Notice: Subject to any disclaimer, the term of this patent is extended or adjusted under 35 U.S.C. 154(b) by 80 days.

(21) Appl. No.: 18/291,405

(22) PCT Filed: Jul. 15, 2022

(86) PCT No.: PCT/JP2022/027912
§ 371 (c)(1),
(2) Date: Jan. 23, 2024

(87) PCT Pub. No.: WO2023/053673
PCT Pub. Date: Apr. 6, 2023

(65) Prior Publication Data

US 2024/0353160 A1 Oct. 24, 2024

(30) Foreign Application Priority Data

Sep. 29, 2021 (JP) ..... 2021-160014

(51) Int. Cl.
*F25B 49/02* (2006.01)
*F24F 11/64* (2018.01)
(Continued)

(52) U.S. Cl.
CPC ..... *F25B 49/02* (2013.01); *F24F 11/64* (2018.01); *F25B 41/40* (2021.01); *F24F 2140/00* (2018.01); *F24F 2140/20* (2018.01)

(58) Field of Classification Search
CPC ..... F25B 49/02; F25B 41/40; F25B 2500/19; F25B 2500/24; F25B 2700/21163;
(Continued)

(56) References Cited

U.S. PATENT DOCUMENTS 9,726,410 B2 8/2017 Gao et al.
11,656,015 B2 * 5/2023 Sata ..... F25B 49/02 62/115

(Continued)

FOREIGN PATENT DOCUMENTS

JP 2006-23072 1/2006
JP 2007-298221 11/2007

(Continued)

OTHER PUBLICATIONS

International Search Report issued in International Patent Application No. PCT/JP2022/027912, dated Oct. 4, 2022, along with an English translation thereof.

(Continued)

*Primary Examiner* — Marc E Norman
(74) *Attorney, Agent, or Firm* — GREENBLUM & BERNSTEIN, P.L.C.

(57) ABSTRACT

An air conditioner includes an outdoor unit, an indoor unit and a refrigerant circuit. The conditioner performs heating operation in which an indoor heat exchanger functions as a condenser for a refrigerant that is compressed by a compressor and an outdoor heat exchanger functions as an evaporator for a refrigerant that is condensed by the indoor heat exchanger. The conditioner includes a memory, and processing circuitry configured to estimate an amount of refrigerant that remains in the circuit by using an operating state quantity of the conditioner in the heating operation. The estimating includes a plurality of different estimation models that correspond to ranges of the amount of refrig- (Continued)

erant that remains in the circuit. One of the estimation models uses, as the operating state quantity, a degree of supercooling of refrigerant at an outlet of the indoor heat exchanger.

21 Claims, 16 Drawing Sheets

(51) Int. Cl.
*F25B 41/40* (2021.01)
*F24F 140/00* (2018.01)
*F24F 140/20* (2018.01)

(58) Field of Classification Search
CPC .. F24F 11/64; F24F 11/30; F24F 11/61; F24F 2140/00; F24F 2140/20
See application file for complete search history.

(56) References Cited

U.S. PATENT DOCUMENTS

2008/0209926 A1 9/2008 Matsuoka et al.
2009/0255284 A1 10/2009 Yoshimi
2017/0219238 A1* 8/2017 Kibo ..... F24F 11/84
2017/0276413 A1 9/2017 Takeichi et al.
2022/0146169 A1* 5/2022 Oka ..... F25B 49/02
2023/0235933 A1* 7/2023 Sasaki ..... F25B 49/02 62/129
2024/0142125 A1* 5/2024 Sasaki ..... F25B 49/005
2024/0175595 A1* 5/2024 Sasaki ..... F24F 11/63

FOREIGN PATENT DOCUMENTS

JP 2015-135192 7/2015
JP 2017-40464 2/2017

OTHER PUBLICATIONS

Written Opinion of the International Searching Authority for International Patent Application No. PCT/JP2022/027912, dated Oct. 4, 2022, along with an English translation thereof.
Extended European Search Report for European Patent Application No. 22875551.8, dated Sep. 12, 2025.

* cited by examiner

FIG.8

| TIME | UNIT | | | |
|---|---|---|---|---|
| | OUTDOOR UNIT | INDOOR UNIT #1 | INDOOR UNIT #2 | INDOOR UNIT #3 |
| 0:00 | SENSOR VALUE IS CHANGED | SENSOR VALUE IS CHANGED | SENSOR VALUE IS CHANGED | SENSOR VALUE IS CHANGED |
| 0:01 | UNCHANGED | SENSOR VALUE IS CHANGED | UNCHANGED | UNCHANGED |
| 0:03 | SENSOR VALUE IS CHANGED | SENSOR VALUE IS CHANGED | UNCHANGED | UNCHANGED |
| 0:06 | UNCHANGED | UNCHANGED | SENSOR VALUE IS CHANGED | UNCHANGED |
| 0:09 | UNCHANGED | UNCHANGED | UNCHANGED | SENSOR VALUE IS CHANGED |
| 0:17 | UNCHANGED | SENSOR VALUE IS CHANGED | SENSOR VALUE IS CHANGED | SENSOR VALUE IS CHANGED |
| 0:27 | UNCHANGED | UNCHANGED | SENSOR VALUE IS CHANGED | UNCHANGED |
| 0:28 | UNCHANGED | UNCHANGED | SENSOR VALUE IS CHANGED | SENSOR VALUE IS CHANGED |
| 0:32 | UNCHANGED | UNCHANGED | SENSOR VALUE IS CHANGED | UNCHANGED |
| 0:35 | SENSOR VALUE IS CHANGED | SENSOR VALUE IS CHANGED | SENSOR VALUE IS CHANGED | SENSOR VALUE IS CHANGED |

| TIME AFTER EDITING | ORIGINAL TIME | UNIT | | | |
|---|---|---|---|---|---|
| | | OUTDOOR UNIT | INDOOR UNIT #1 | INDOOR UNIT #2 | INDOOR UNIT #3 |
| 0:05 | 0:00 | SENSOR VALUE IS CHANGED | SENSOR VALUE IS CHANGED | SENSOR VALUE IS CHANGED | SENSOR VALUE IS CHANGED |
| | 0:01 | UNCHANGED | SENSOR VALUE IS CHANGED | UNCHANGED | UNCHANGED |
| | 0:03 | SENSOR VALUE IS CHANGED | SENSOR VALUE IS CHANGED | UNCHANGED | UNCHANGED |
| 0:10 | 0:06 | PREVIOUS SENSOR VALUE | PREVIOUS SENSOR VALUE | SENSOR VALUE IS CHANGED | UNCHANGED |
| | 0:09 | UNCHANGED | UNCHANGED | UNCHANGED | SENSOR VALUE IS CHANGED |
| 0:15 | | PREVIOUS SENSOR VALUE | PREVIOUS SENSOR VALUE | PREVIOUS SENSOR VALUE | PREVIOUS SENSOR VALUE |
| 0:20 | 0:17 | PREVIOUS SENSOR VALUE | SENSOR VALUE IS CHANGED | SENSOR VALUE IS CHANGED | SENSOR VALUE IS CHANGED |
| 0:25 | 0:27 | PREVIOUS SENSOR VALUE | PREVIOUS SENSOR VALUE | SENSOR VALUE IS CHANGED | UNCHANGED |
| | 0:28 | UNCHANGED | UNCHANGED | SENSOR VALUE IS CHANGED | SENSOR VALUE IS CHANGED |
| 0:30 | | PREVIOUS SENSOR VALUE | PREVIOUS SENSOR VALUE | PREVIOUS SENSOR VALUE | PREVIOUS SENSOR VALUE |
| 0:35 | 0:32 | UNCHANGED | UNCHANGED | SENSOR VALUE IS CHANGED | UNCHANGED |
| | 0:35 | SENSOR VALUE IS CHANGED | SENSOR VALUE IS CHANGED | SENSOR VALUE IS CHANGED | SENSOR VALUE IS CHANGED |

AIR CONDITIONER AND AIR CONDITIONING SYSTEM

FIELD

The present invention relates to an air conditioner or an air conditioning system that has a function to estimate a shortage amount (or a remaining amount) of refrigerant that is stored in a refrigerant circuit of the air conditioner, in particular, a function to estimate a shortage amount (or a remaining amount) of refrigerant that is stored in a refrigerant circuit of the air conditioner of a separate time in which a heat-source-side unit (hereinafter, also referred to as an outdoor unit) and a use-side unit (hereinafter, also referred to as an indoor unit) are connected to each other via a refrigerant connection pipe.

BACKGROUND

An air conditioner that determines appropriateness of a refrigerant amount by using an operating state quantity that can be detected by a refrigerant circuit has been proposed. In Patent Literature 1, for example, the appropriateness of the refrigerant amount is determined by using a degree of supercooling at an outlet of a heat-source-side heat exchanger in a refrigerant amount determination operation mode (hereinafter, also referred to as a default state) in which a use-side unit is caused to perform cooling operation, in which a use-side expansion valve is controlled such that a degree of superheat at an outlet of a use-side heat exchanger becomes a positive value (a gas refrigerant at the outlet of the use-side heat exchanger is in an overheated state), and in which operating capacity of a compressor is controlled such that evaporation pressure of the use-side heat exchanger reaches a predetermined value.

CITATION LIST

Patent Literature

Patent Literature 1: Japanese Laid-open Patent Publication No. 2006-23072

SUMMARY

Technical Problem

In the air conditioner, when determining the appropriateness of the refrigerant amount by using the operating state quantity, such as the degree of supercooling, the refrigerant circuit needs to be set to the default state as described above. Further, the degree of supercooling at the time of determination of the appropriateness of the refrigerant amount is compared with a degree of supercooling at a time immediately after a prescribed amount of refrigerant is stored. As a result of the comparison of values of the degrees of supercooling, if the degree of supercooling is reduced at the time of the determination of the appropriateness of the refrigerant amount, it is determined that the state is a state in which the refrigerant amount is small (inappropriate state).

However, it is not always the case that an external environment, such as outside temperature or indoor temperature, at the time of the determination of the appropriateness of the refrigerant amount is the same as an external environment immediately after the prescribed amount of the refrigerant is stored, due to an influence of a difference of seasons, a difference of an amount of solar radiation, or the like. Therefore, in some cases, it is difficult to adjust the state of the refrigerant circuit to the default state (for example, the evaporation pressure is adjusted to a predetermined value) when the appropriateness of the refrigerant amount is to be determined, and it is difficult to adjust the state to the default state at a desired timing, so that it becomes difficult to determine the appropriateness of the refrigerant amount. Further, in the refrigerant circuit as described above, the operating state quantity that is detected by the refrigerant circuit differs depending on an amount of refrigerant that remains in the refrigerant circuit, so that the state of the refrigerant circuit differs between when an adequate amount of refrigerant is stored and when the adequate amount of refrigerant is not stored. Therefore, in the method of Patent Literature 1 in which the appropriateness of the refrigerant amount is determined based on a magnitude of the degree of supercooling at the outlet of the heat-source-side heat exchanger, it is difficult to accurately determine the shortage amount (or the remaining amount) of the refrigerant even if it is possible to determine a refrigerant shortage state in the refrigerant circuit.

Furthermore, in the method of Patent Literature 1 in which the use-side unit is caused to perform cooling operation, it is difficult to determine even the shortage amount (or the remaining amount) of the refrigerant by using the degree of supercooling when the use-side unit is caused to perform heating operation.

In view of the problems as described above, an object of the present invention is to provide an air conditioner that is able to determine a shortage amount (or a remaining amount) of refrigerant even in a state in which the use-side unit is caused to perform heating operation, independently of the remaining refrigerant amount.

Solution to Problem

An air conditioner according to an aspect includes an outdoor, an indoor unit and a refrigerant circuit. The outdoor unit includes a compressor, an outdoor heat exchanger, and an expansion valve. The indoor unit includes an indoor heat exchanger. The outdoor unit and the indoor unit in the refrigerant circuit are connected to each other by a refrigerant pipe. The air conditioner performs at least heating operation in which the indoor heat exchanger functions as a condenser for a refrigerant that is compressed by the compressor and the outdoor heat exchanger functions as an evaporator for a refrigerant that is condensed by the indoor heat exchanger. The air conditioner includes a memory; and processing circuitry coupled to the memory and configured to estimate an amount of refrigerant that remains in the refrigerant circuit by using an operating state quantity of the air conditioner in at least the heating operation. The estimating includes a plurality of different estimation models that correspond to ranges of the amount of refrigerant that remains in the refrigerant circuit. One of the estimation models uses, as the operating state quantity, a degree of supercooling of refrigerant at an outlet of the indoor heat exchanger.

Advantageous Effects of Invention

According to one aspect, it is possible to determine a refrigerant amount at a desired timing and independently of a remaining refrigerant amount.

BRIEF DESCRIPTION OF DRAWINGS

FIG. 8 is an explanatory diagram illustrating an example of a sensor value editing process.

DESCRIPTION OF EMBODIMENTS

Embodiments of an air conditioner and the like disclosed in the present application will be described in detail below based on the drawings. Meanwhile, the disclosed technology is not limited by the present embodiments. In addition, each of the embodiments described below may be modified appropriately as long as no contradiction is derived.

First Embodiment

Configuration of Air Conditioner

Figure 1:
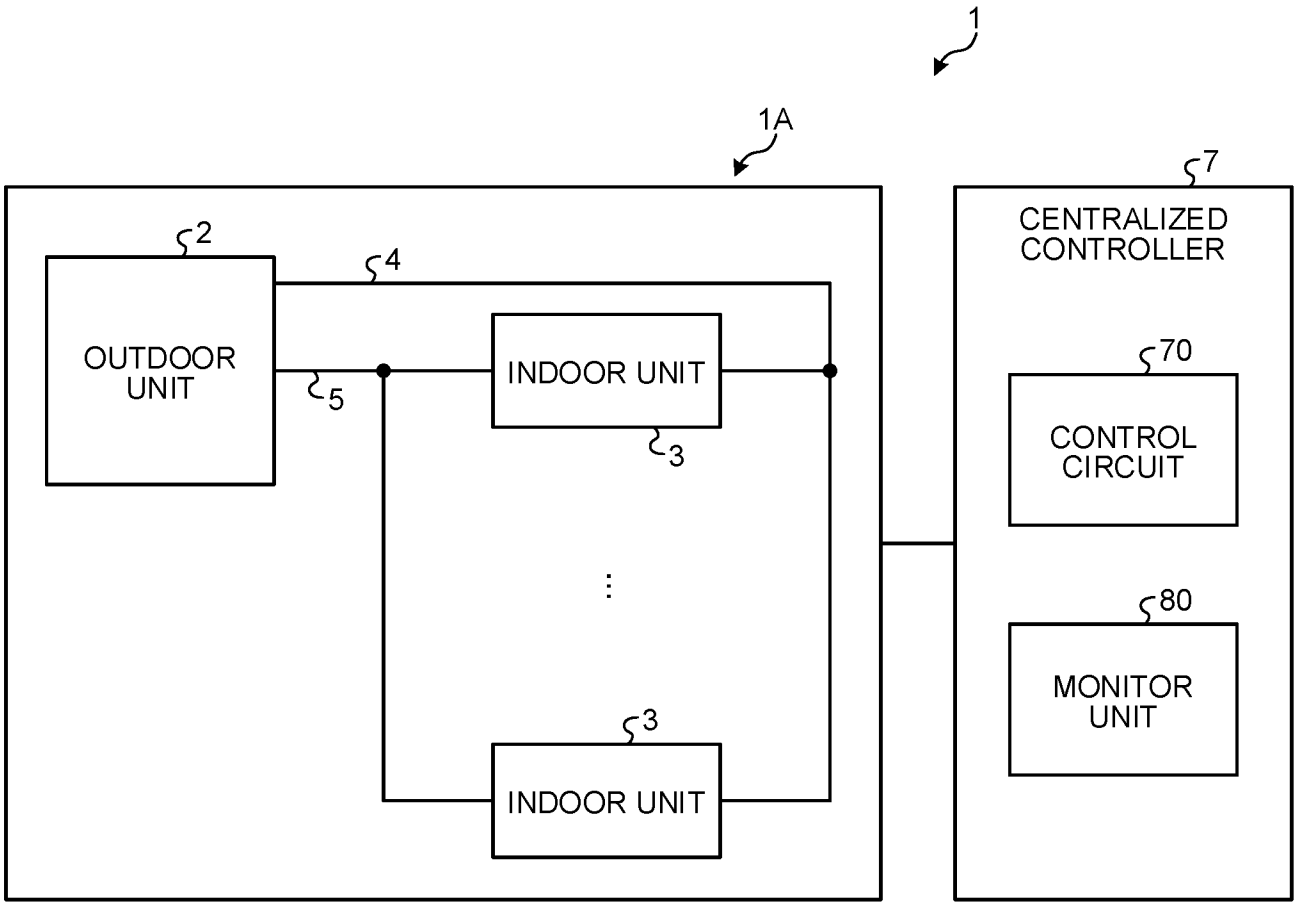
FIG. 1 is an explanatory diagram illustrating an example of an air conditioner of the present embodiment.

FIG. 1 is an explanatory diagram illustrating an example of an air conditioner 1 of the present embodiment. The air conditioner 1 illustrated in FIG. 1 includes a single outdoor unit 2, N indoor units 3, individual controllers (not illustrated) serving as individual control means that individually control the respective indoor units 3, and a centralized controller 7 serving as a centralized control means that displays and controls states of the outdoor unit 2 and the indoor units 3 (for example, operating information or the like to be described later (N is a natural number equal to or larger than 2). The outdoor unit 2 is connected to each of the indoor units 3 in a parallel manner via a liquid pipe 4 and a gas pipe 5. Further, a refrigerant circuit 6 of the air conditioner 1 is formed by connecting the outdoor unit 2 and the indoor units 3 to each other by refrigerant pipes, such as the liquid pipe 4 and the gas pipe 5. The indoor units 3 receive operating instructions from a user by the individual controllers and perform air conditioning operation for the respective indoor units 3. The centralized controller 7 includes a monitor unit 80 that displays a state of an air conditioner main body 1A including the outdoor unit 2 and the indoor units 3 and a control circuit 70 that controls the air conditioner main body 1A.

Configuration of Outdoor Unit

Figure 2:
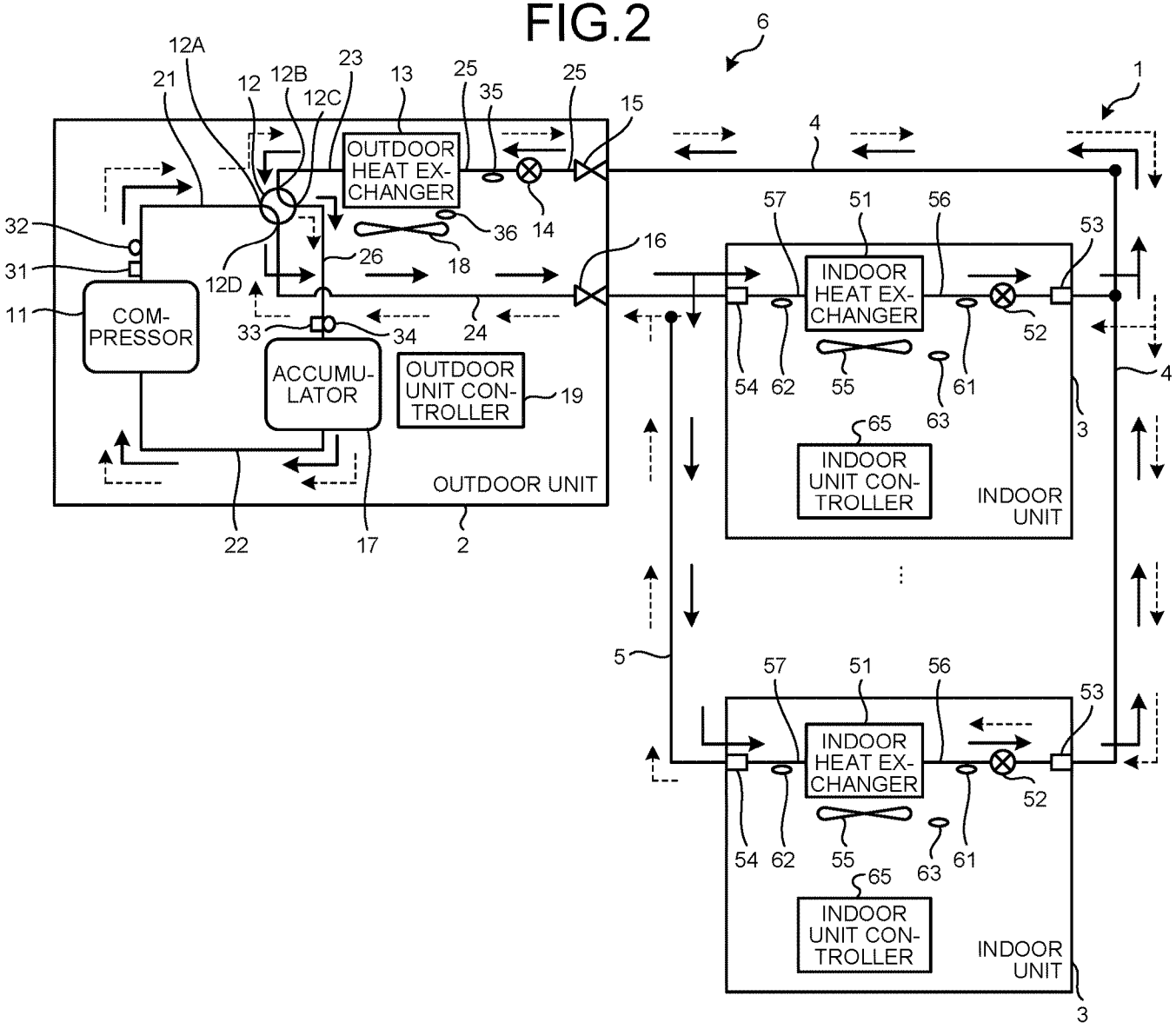
FIG. 2 is an explanatory diagram illustrating an example of an outdoor unit and indoor units.

FIG. 2 is an explanatory diagram illustrating an example of the outdoor unit 2 and the N indoor units 3. The outdoor unit 2 includes a compressor 11, a four-way valve 12, an outdoor heat exchanger 13, an outdoor unit expansion valve 14, a first stop valve 15, a second stop valve 16, an accumulator 17, an outdoor unit fan 18, and an outdoor unit controller 19. The compressor 11, the four-way valve 12, the outdoor heat exchanger 13, the outdoor unit expansion valve 14, the first stop valve 15, the second stop valve 16, and the accumulator 17 as described above are connected to one another by each of refrigerant pipes to be described in detail below, and used to form an outdoor-side refrigerant circuit that is a part of the refrigerant circuit 6.

The compressor 11 is, for example, a variable capacity compressor of a pressurized container type in which operating capacity can be changed in accordance with drive of a motor (not illustrated) for which rotation speed is controlled by an inverter. A refrigerant discharge side of the compressor 11 is connected to a first port 12A of the four-way valve 12 by a discharge pipe 21. Further, a refrigerant suction side of the compressor 11 is connected to a refrigerant outflow side of the accumulator 17 by a suction pipe 22.

The four-way valve 12 is a valve for changing a flow direction of refrigerant in the refrigerant circuit 6, and includes the first port 12A to a fourth port 12D. The first port 12A is connected to the refrigerant discharge side of the compressor 11 by the discharge pipe 21. The second port 12B is connected to one refrigerant port of the outdoor heat exchanger 13 by an outdoor refrigerant pipe 23. The third port 12C is connected to a refrigerant inflow side of the accumulator 17 by an outdoor refrigerant pipe 26. Further, the fourth port 12D is connected to the second stop valve 16 by an outdoor gas pipe 24.

The outdoor heat exchanger 13 performs heat exchange between the refrigerant and outdoor air that is taken into the outdoor unit 2 by rotation of the outdoor unit fan 18. The one refrigerant port of the outdoor heat exchanger 13 is connected to the second port 12B of the four-way valve 12 by the outdoor refrigerant pipe 23. Another refrigerant port of the outdoor heat exchanger 13 is connected to the first stop valve 15 by an outdoor liquid pipe 25. The outdoor heat exchanger 13 functions as a condenser when the air conditioner 1 performs cooling operation, and functions as an evaporator when the air conditioner 1 performs heating operation.

The outdoor unit expansion valve 14 is an electronic expansion valve that is arranged in the outdoor liquid pipe 25 and that is driven by a pulse motor (not illustrated). A degree of opening of the outdoor unit expansion valve 14 is adjusted in accordance with the number of pulses given to the pulse motor, so that an amount of the refrigerant that flows into the outdoor heat exchanger 13 or an amount of the refrigerant that flows out of the outdoor heat exchanger 13 is adjusted. The degree of opening of the outdoor unit expansion valve 14 is adjusted such that when the air conditioner 1 performs heating operation, a degree of suction superheat of refrigerant at the refrigerant suction side of the compressor 11 reaches a target suction superheat. Further, the degree of opening of the outdoor unit expansion valve 14 is set to a fully-opened state when the air conditioner 1 performs cooling operation.

The refrigerant inflow side of the accumulator 17 is connected to the third port 12C of the four-way valve 12 by the outdoor refrigerant pipe 26. Further, the refrigerant outflow side of the accumulator 17 is connected to a refrigerant inflow side of the compressor 11 by the suction pipe 22. The accumulator 17 separates the refrigerant that has flown into the accumulator 17 from the outdoor refrigerant pipe 26 into gas refrigerant and liquid refrigerant, and causes only the gas refrigerant to be sucked into the compressor 11.

The outdoor unit fan 18 is made of a resin material and arranged in the vicinity of the outdoor heat exchanger 13. The outdoor unit fan 18 takes outdoor air into the outdoor unit 2 from a suction port (not illustrated) in accordance with rotation of a fan motor (not illustrated), and discharges the outdoor air, which has been subjected to heat exchange with the refrigerant in the outdoor heat exchanger 13, to the outside of the outdoor unit 2 from a discharge port (not illustrated).

Further, a plurality of sensors are arranged in the outdoor unit 2. In the discharge pipe 21, a discharge pressure sensor 31 that detects discharge pressure as pressure of the refrigerant that is discharged from the compressor 11, and a discharge temperature sensor 32 that detects temperature of the refrigerant that is discharged from the compressor 11, that is, discharge temperature, are arranged. In the vicinity of a refrigerant inlet of the accumulator 17 in the outdoor refrigerant pipe 26, a suction pressure sensor 33 that detects suction pressure as pressure of the refrigerant that is sucked into the compressor 11, and a suction temperature sensor 34 that detects temperature of the refrigerant that is sucked into the compressor 11 are arranged.

In the outdoor liquid pipe 25 between the outdoor heat exchanger 13 and the outdoor unit expansion valve 14, a heat exchange outlet temperature sensor 35 that detects temperature of the refrigerant that flows into the outdoor heat exchanger 13 or temperature of the refrigerant that flows out of the outdoor heat exchanger 13 is arranged. Furthermore, in the vicinity of a suction port (not illustrated) of the outdoor unit 2, an outdoor air temperature sensor 36 that detects temperature of outdoor air that flows into the outdoor unit 2, that is, outdoor air temperature, is arranged.

Figure 3A:
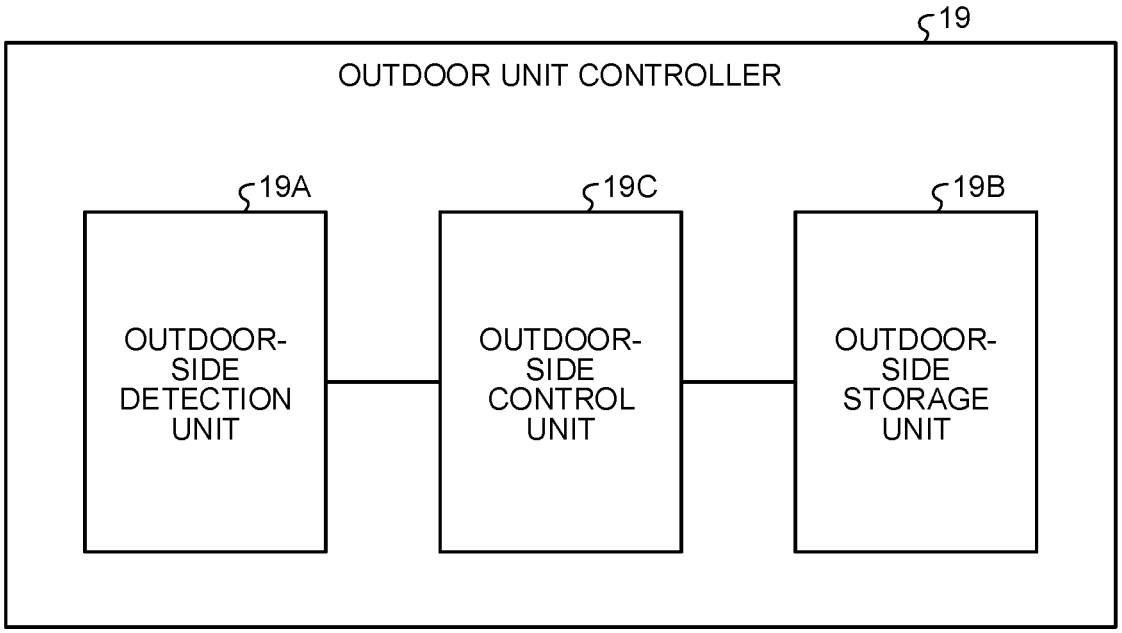
FIG. 3A is a block diagram illustrating an example of an outdoor unit controller of the outdoor unit.

FIG. 3A is a block diagram illustrating an example of the outdoor unit controller 19 of the outdoor unit 2. The outdoor unit controller 19 illustrated in FIG. 3A includes an outdoor-side detection unit 19A, an outdoor-side storage unit 19B, and an outdoor-side control unit 19C. The outdoor-side detection unit 19A detects an outdoor-side operating state quantity that is an operating state quantity at the side of the outdoor unit 2 among operating state quantities. The outdoor-side detection unit 19A is each of the sensors in the outdoor unit 2. The outdoor-side storage unit 19B stores therein an outdoor-side detection result that is detected by the outdoor-side detection unit 19A. The outdoor-side detection result includes a detection result of each of the sensors of the outdoor unit 2 and a detection time of each of the sensors. The outdoor-side control unit 19C controls operation of each of the units of the outdoor unit 2. As for transfer of the outdoor-side detection result that is stored in the outdoor-side storage unit 19B to the centralized controller 7, only when there is a change from a sensor value at the previous time in the outdoor-side detection result, the outdoor-side control unit 19C transfers a sensor value at this time as the outdoor-side detection result to the centralized controller 7. Further, when there is no change from the sensor value at the previous detection time, the outdoor-side control unit 19C does not transfer the outdoor-side detection result to the centralized controller 7.

Configuration of Indoor Unit

As illustrated in FIG. 2, the indoor unit 3 includes an indoor heat exchanger 51, an indoor unit expansion valve 52, a liquid pipe connection portion 53, a gas pipe connection portion 54, an indoor unit fan 55, and an indoor unit controller 65. The indoor heat exchanger 51, the indoor unit expansion valve 52, the liquid pipe connection portion 53, and the gas pipe connection portion 54 are connected to one another by each of refrigerant pipes to be described later, and constitutes an indoor unit refrigerant circuit that is a part of the refrigerant circuit 6.

The indoor heat exchanger 51 performs heat exchange between the refrigerant and indoor air that is taken into the indoor unit 3 from a suction port (not illustrated) by rotation of the indoor unit fan 55. One refrigerant port of the indoor heat exchanger 51 is connected to the liquid pipe connection portion 53 by an indoor liquid pipe 56. Further, another refrigerant port of the indoor heat exchanger 51 is connected to the gas pipe connection portion 54 by an indoor gas pipe 57. The indoor heat exchanger 51 functions as a condenser when the air conditioner 1 performs heating operation. In contrast, the indoor heat exchanger 51 functions as an evaporator when the air conditioner 1 performs cooling operation.

The indoor unit expansion valve 52 is arranged in the indoor liquid pipe 56 and is an electronic expansion valve. When the indoor heat exchanger 51 functions as an evaporator, that is, when the indoor unit 3 performs cooling operation, a degree of opening of the indoor unit expansion valve 52 is adjusted such that a degree of superheat of refrigerant at a refrigerant outlet side (at the side of the gas pipe connection portion 54) of the indoor heat exchanger 51 reaches a target degree of superheat of the refrigerant. Further, when the indoor heat exchanger 51 functions as a condenser, that is, when the indoor unit 3 performs heating operation, the degree of opening of the indoor unit expansion valve 52 is adjusted such that a degree of supercooling of refrigerant at a refrigerant outlet side (at the side of the liquid pipe connection portion 53) of the indoor heat exchanger 51 reaches a target degree of supercooling of the refrigerant. Here, the target degree of superheat of the refrigerant and the target degree of supercooling of the refrigerant are a degree of superheat of the refrigerant and a degree of supercooling of the refrigerant that are needed to cause the indoor unit 3 to fully demonstrate cooling capacity and heating capacity.

The indoor unit fan 55 is made of a resin material and arranged in the vicinity of the indoor heat exchanger 51. The indoor unit fan 55, by being rotated by a fan motor (not illustrated), takes indoor air into the indoor unit 3 from a suction port (not illustrated), and discharges the indoor air that has been subjected to heat exchange with the refrigerant in the indoor heat exchanger 51 from a discharge port (not illustrated).

Various sensors are arranged in the indoor unit 3. In the indoor liquid pipe 56, a liquid-side refrigerant temperature sensor 61 that detects temperature of the refrigerant that flows into the indoor heat exchanger 51 or temperature of the refrigerant that flows out of the indoor heat exchanger 51 is arranged between the indoor heat exchanger 51 and the indoor unit expansion valve 52. In the indoor gas pipe 57, a gas-side temperature sensor 62 that detects temperature of the refrigerant that flows out of the indoor heat exchanger 51 or temperature of the refrigerant that flows into the indoor heat exchanger 51 is arranged. In the vicinity of a suction port (not illustrated) of the indoor unit 3, a suction temperature sensor 63 that detects temperature of the indoor air that flows into the indoor unit 3, that is, suction temperature, is arranged.

Figure 3B:
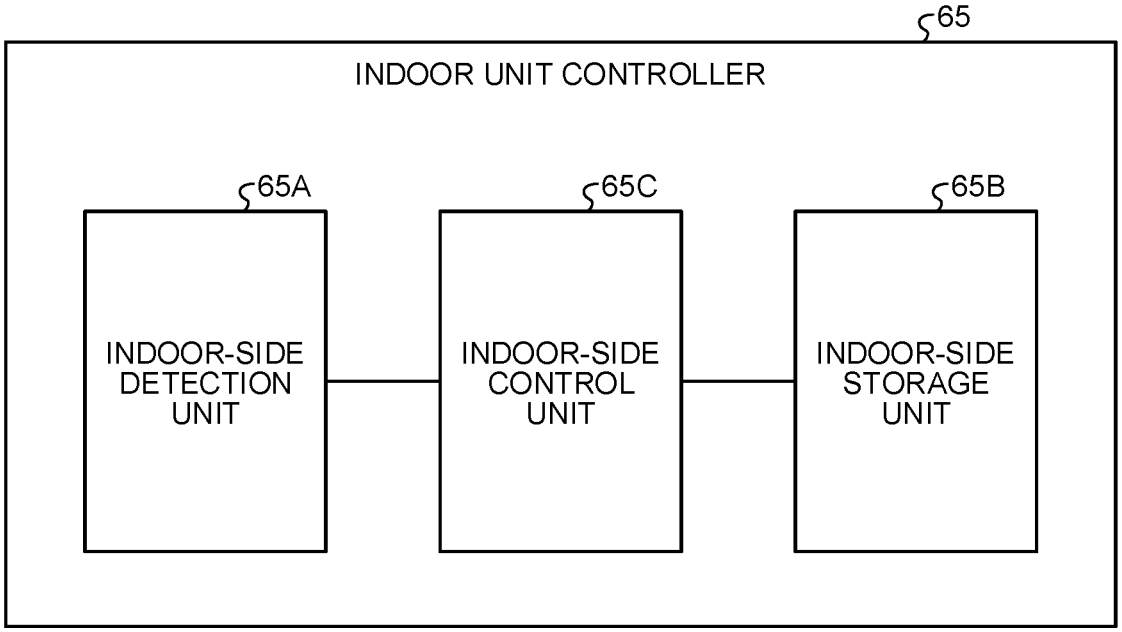
FIG. 3B is a block diagram illustrating an example of an indoor unit controller of the indoor unit.

FIG. 3B is a block diagram illustrating an example of the indoor unit controller 65 of the indoor unit 3. The indoor unit controller 65 illustrated in FIG. 3B includes an indoor-side detection unit 65A, an indoor-side storage unit 65B, and an indoor-side control unit 65C. The indoor-side detection unit 65A detects an indoor-side operating state quantity that is an operating state quantity at the side of the indoor unit 3 among operating state quantities. The indoor-side detection unit 65A is each of the sensors in the indoor unit 3. The indoor-side storage unit 65B stores therein an indoor-side detection result that is detected by the indoor-side detection unit 65A. The indoor-side detection result includes a detection result of each of the sensors of the indoor unit 3 and a detection time of each of the sensors. The indoor-side control unit 65C receives an operating instruction given by a user from an individual controller (not illustrated). The indoor-side control unit 65C that has received the operating instruction controls operation of each of the units of the indoor unit 3 in accordance with instruction details. Further, the indoor-side control unit 65C transfers the indoor-side detection result that is stored in the indoor-side storage unit 65B to the centralized controller 7 via the outdoor unit controller 19. In this case, only when there is a change from a sensor value at the previous time in the indoor-side detection result, the indoor-side control unit 65C transfers a sensor value at this time as the indoor-side detection result to the centralized controller 7. Furthermore, when there is no change from the sensor value at the previous detection time, the indoor-side control unit 65C does not transfer the indoor-side detection result to the centralized controller 7.

Operation of Refrigerant Circuit

Flow of the refrigerant in the refrigerant circuit 6 and operation of each of the units when the air conditioner 1 of the present embodiment performs air conditioning operation will be described below. Meanwhile, arrows in FIG. 2 indicate flows of the refrigerant at the time of heating operation.

When the air conditioner 1 performs heating operation, the four-way valve 12 is switched such that the first port 12A and the fourth port 12D communicate with each other and the second port 12B and the third port 12C communicate with each other. Accordingly, the refrigerant circuit 6 enters a heating cycle in which each of the indoor heat exchangers 51 functions as a condenser and the outdoor heat exchanger 13 functions as an evaporator. Meanwhile, for convenience of explanation, the flow of the refrigerant at the time of heating operation is indicated by bold arrows in FIG. 2.

If the compressor 11 drives when the refrigerant circuit 6 is in the state as described above, the refrigerant that is discharged from the compressor 11 flows through the discharge pipe 21, flows into the four-way valve 12, flows through the outdoor gas pipe 24 from the four-way valve 12, and flows into the gas pipe 5 via the second stop valve 16. The refrigerant that flows through the gas pipe 5 flows into each of the indoor units 3 in a distributed manner via each of the gas pipe connection portions 54. The refrigerant that has flown into each of the indoor units 3 in a distributed manner flows through each of the indoor gas pipes 57 and flows into each of the indoor heat exchangers 51. The refrigerant that has flown into each of the indoor heat exchangers 51 is subjected to heat exchange with the indoor air that is taken into each of the indoor units 3 by rotation of each of the indoor unit fans 55, and condenses. In other words, each of the indoor heat exchangers 51 functions as a condenser and the indoor air that is heated by the refrigerant in each of the indoor heat exchangers 51 is blown into a room from a discharge port (not illustrated), so that the room in which each of the indoor units 3 is installed is heated.

The refrigerant that has flown into each of the indoor liquid pipes 56 from each of the indoor heat exchangers 51 is depressurized by passing through each of the indoor unit expansion valves 52 for which the degree of opening is adjusted such that the degree of supercooling of the refrigerant at a refrigerant outlet side of each of the indoor heat exchangers 51 reaches a target degree of supercooling of the refrigerant. Here, the target degree of supercooling of the refrigerant is determined based on cooling capacity that is needed in each of the indoor units 3.

The refrigerant that has been depressurized by each of the indoor unit expansion valves 52 flows out to the liquid pipe 4 from each of the indoor liquid pipes 56 via each of the liquid pipe connection portions 53. The refrigerants that are collected in the liquid pipe 4 flow into the outdoor unit 2 via the first stop valve 15. The refrigerant that has flown into the first stop valve 15 of the outdoor unit 2 flows through the outdoor liquid pipe 25 and depressurized by passing through the outdoor unit expansion valve 14. The refrigerant that has been depressurized by the outdoor unit expansion valve 14 flows through the outdoor liquid pipe 25, flows into the outdoor heat exchanger 13, is subjected to heat exchange with the outdoor air that has flown through the suction port (not illustrated) of the outdoor unit 2 by rotation of the outdoor unit fan 18, and evaporates. The refrigerant that has flown out to the outdoor refrigerant pipe 26 from the outdoor heat exchanger 13 flows into the four-way valve 12, the outdoor refrigerant pipe 26, the accumulator 17, and the suction pipe 22 in this order, is sucked into the compressor 11 where the refrigerant is compressed again, and flows out to the outdoor gas pipe 24 through the first port 12A and the fourth port 12D of the four-way valve 12.

Further, when the air conditioner 1 performs cooling operation, the four-way valve 12 is switched such that the first port 12A and the second port 12B communicate with each other and the third port 12C and the fourth port 12D communicate with each other. Accordingly, the refrigerant circuit 6 enters a cooling cycle in which each of the indoor heat exchangers 51 functions as an evaporator and the outdoor heat exchanger 13 functions as a condenser. Meanwhile, for convenience of explanation, the flow of the refrigerant at the time of cooling operation is indicated by dashed arrows in FIG. 2.

If the compressor 11 drives when the refrigerant circuit 6 is in the state as described above, the refrigerant that is discharged from the compressor 11 flows through the discharge pipe 21, flows into the four-way valve 12, flows through the outdoor refrigerant pipe 23 from the four-way valve 12, and flows into the outdoor heat exchanger 13. The refrigerant that has flown into the outdoor heat exchanger 13 is subjected to heat exchange with outdoor air that is taken into the outdoor unit 2 by rotation of the outdoor unit fan 18, and condenses. In other words, the outdoor heat exchanger 13 functions as a condenser and the outdoor air that is heated by the refrigerant in the outdoor heat exchanger 13 is blown out of the room from a discharge port (not illustrated).

The refrigerant that has flown into the outdoor liquid pipe 25 from the outdoor heat exchanger 13 is depressurized by passing through the outdoor unit expansion valve 14 for which the degree of opening is adjusted to full-open. The refrigerant that has been depressurized by the outdoor unit expansion valve 14 flows through the liquid pipe 4 via the first stop valve 15 and flows into each of the indoor units 3 in a distributed manner. The refrigerant that has flown into each of the indoor units 3, flows through the indoor liquid pipe 56 via each of the liquid pipe connection portions 53 and is depressurized by passing through the indoor unit expansion valve 52 for which the degree of opening is adjusted such that the degree of supercooling of the refrigerant at the refrigerant outlet of the indoor heat exchanger 51 reaches the target degree of supercooling of the refrigerant. The refrigerant that has been depressurized by the indoor unit expansion valve 52 flows through the indoor liquid pipe 56, flows into the indoor heat exchanger 51, is subjected to heat exchange with the indoor air that has flown in from the suction port (not illustrated) of the indoor unit 3 by rotation of the indoor unit fan 55, and evaporates. In other words, each of the indoor heat exchangers 51 functions as an evaporator and the indoor air that is cooled by the refrigerant in each of the indoor heat exchangers 51 is blown into the room from a discharge port (not illustrated), so that the room in which each of the indoor units 3 is installed is cooled.

The refrigerant that flows into the gas pipe 5 from the indoor heat exchanger 51 via the gas pipe connection portion 54 flows through the outdoor gas pipe 24 via the second stop valve 16 of the outdoor unit 2, and flows into the fourth port 12D of the four-way valve 12. The refrigerant that has flown into the fourth port 12D of the four-way valve 12 flows into the refrigerant inflow side of the accumulator 17 via the third port 12C. The refrigerant that has flown in from the refrigerant inflow side of the accumulator 17 flows in via the suction pipe 22, is sucked by the compressor 11, and is compressed again.

At the time of heating operation, the indoor heat exchanger 51 functions as a condenser for the refrigerant that is compressed by the compressor 11 and the outdoor heat exchanger 13 functions as an evaporator for the refrigerant that is condensed by the indoor heat exchanger 51.

Control Circuit in Centralized Controller

Figure 4:
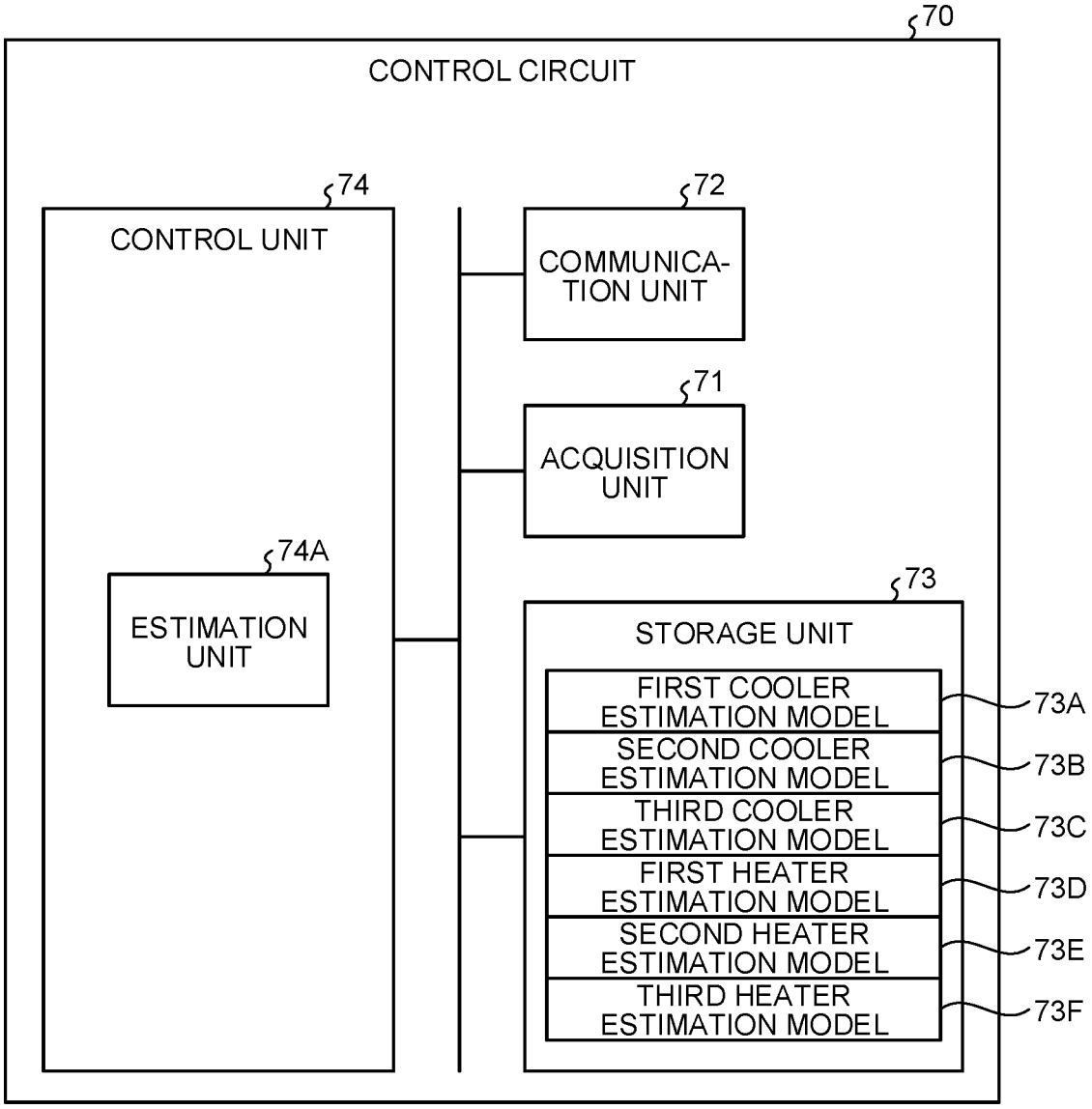
FIG. 4 is a block diagram illustrating an example of a control circuit of a centralized controller.

The control circuit 70 in the centralized controller 7 controls the entire air conditioner 1. FIG. 4 is a block diagram illustrating an example of the control circuit 70 in the centralized controller 7. The control circuit 70 includes an acquisition unit 71, a communication unit 72, a storage unit 73, and a control unit 74. The acquisition unit 71 acquires sensor values of the various sensors as described above. The acquisition unit 71 acquires sensor values of the discharge pressure sensor 31, the discharge temperature sensor 32, the suction pressure sensor 33, the suction temperature sensor 63, the heat exchange outlet temperature sensor 35, and the outdoor air temperature sensor 36 in the outdoor unit 2. Further, the acquisition unit 71 acquires sensor values of the liquid-side refrigerant temperature sensor 61, the gas-side temperature sensor 62, and the suction temperature sensor 63 of each of the indoor units 3.

The communication unit 72 is a communication interface for performing communication with communication units of the outdoor unit 2 and each of the indoor units 3. The storage unit 73 is, for example, a flash memory, and stores therein a control program of the outdoor unit 2, operating state quantities, such as detection values, corresponding to detection signals from the various kinds of sensors, operating information on the outdoor unit 2 (for example, including operating and stop information, a driving state of the compressor 11 or the outdoor unit fan 18, or the like), operating information transmitted from each of the indoor units 3 (for example, including operating and stop information, an operating mode, such as cooling or heating, or the like), rated capacity of the outdoor unit 2, requested capacity of each of the indoor units 3, or the like.

In the present embodiment, the storage unit 73 stores therein an estimation model that estimates an amount of refrigerant that remains in the refrigerant circuit 6. In the present embodiment, for example, a relative refrigerant amount is used as the amount of refrigerant that remains in the refrigerant circuit 6. Specifically, the storage unit 73 of the present embodiment stores therein an estimation model that estimates a refrigerant shortage rate of the refrigerant circuit 6 (indicating an amount of decrease from a prescribed amount, where 100% indicates that the prescribed amount of refrigerant is stored in the refrigerant circuit 6, and the same applies to the following). The estimation model stored in the storage unit 73 includes a first cooler estimation model 73A that corresponds to a range in which the refrigerant shortage rate is low (a range in which the remaining refrigerant amount is large), for example. Further, the estimation model stored in the storage unit 73 includes a second cooler estimation model 73B that corresponds to a range in which the refrigerant shortage rate is high (a range in which the remaining refrigerant amount is small), for example. Furthermore, the estimation model stored in the storage unit 73 includes a third cooler estimation model 73C in which the first cooler estimation model 73A and the second cooler estimation model 73B are combined, for example. Moreover, the estimation model stored in the storage unit 73 includes a first heater estimation model 73D that corresponds to a range in which the refrigerant shortage rate is low (a range in which the remaining refrigerant amount is large), for example. Furthermore, the estimation model stored in the storage unit 73 includes a second heater estimation model 73E that corresponds to a range in which the refrigerant shortage rate is high (a range in which the remaining refrigerant amount is small), for example. Moreover, the estimation model stored in the storage unit 73 includes a third heater estimation model 73F in which the first heater estimation model 73D and the second heater estimation model 73E are combined, for example.

The control unit 74 periodically (for example, every 30 seconds) acquires the detected values that are obtained by the various kinds of sensors via the communication unit 72, and receives input of signals including the operating information that is transmitted from each of the indoor units 3 via the communication unit 72. The control unit 74 adjusts the degree of opening of the outdoor unit expansion valve 14 and controls drive of the compressor 11 based on the various kinds of input information as described above. Further, the control unit 74 includes an estimation unit 74A that estimates the refrigerant shortage rate by using each of the estimation models as described above.

The estimation unit 74A estimates the amount of refrigerant that remains in the refrigerant circuit 6 by using a plurality of different estimation models depending on a range of the refrigerant shortage rate in the refrigerant circuit 6, for example, by using the operating state quantity of the air conditioner main body 1A at the time of heating operation. The estimation unit 74A, when the indoor heat exchangers 51 of at least two of the indoor units 3 are caused to function as condensers for the refrigerant, estimates the refrigerant amount by an estimation model by using the degree of supercooling of the refrigerant at the outlets of the indoor heat exchangers 51 that function as the condensers.

Figure 5:
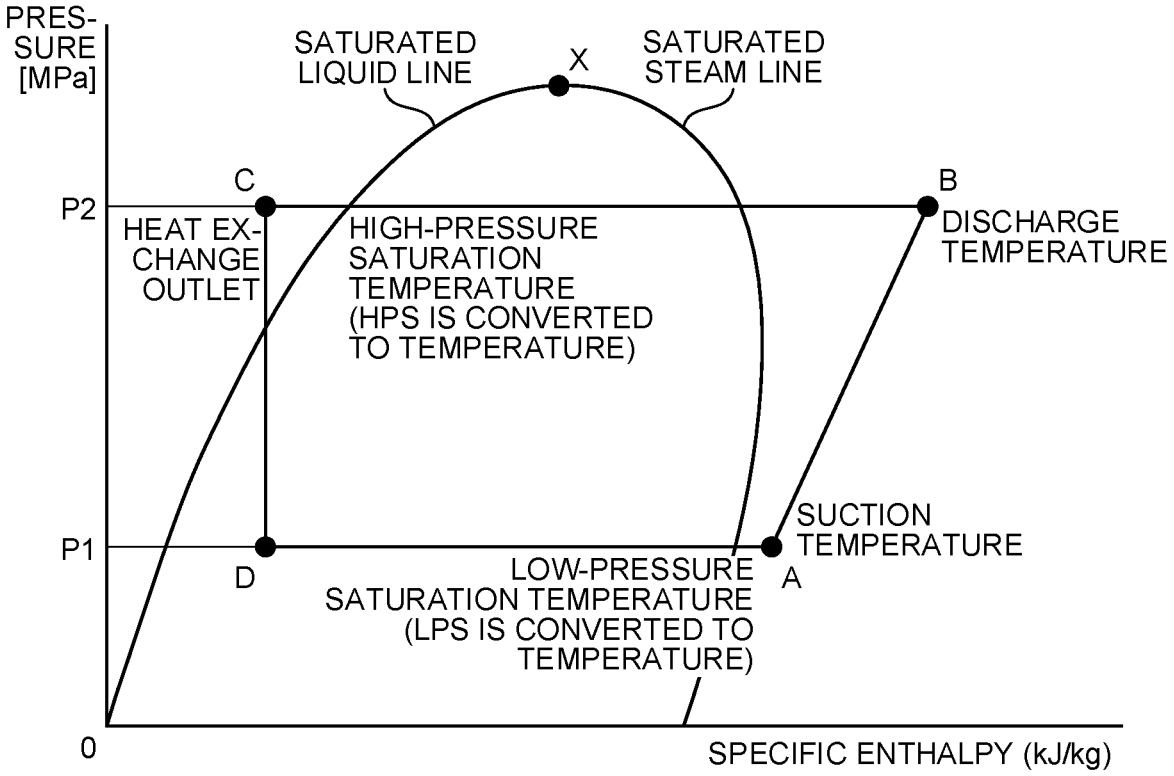
FIG. 5 is a Mollier diagram illustrating a state of a change in a refrigerant of the air conditioner.

FIG. 5 is a Mollier diagram illustrating a cooling cycle of the air conditioner 1. When the air conditioner 1 performs cooling operation, the outdoor heat exchanger 13 functions as a condenser and the indoor heat exchanger 51 functions as an evaporator. Further, when the air conditioner 1 performs heating operation, the outdoor heat exchanger 13 functions as an evaporator and the indoor heat exchanger 51 functions as a condenser.

The compressor 11 compresses a low-temperature and low-pressure gas refrigerant that flows in from the evaporator, and discharges a high-temperature and high-pressure gas refrigerant (a refrigerant in the state at a point B in FIG. 5). Meanwhile, the temperature of the gas refrigerant that is discharged from the compressor 11 is discharge temperature and the discharge temperature is detected by the discharge temperature sensor 32.

The condenser performs heat exchange between the high-temperature and high-pressure gas refrigerant coming from the compressor 11 with air, and condenses the gas refrigerant. In this case, in the condenser, the entire gas refrigerant turns into a liquid refrigerant due to a latent heat change, and thereafter, the temperature of the liquid refrigerant is reduced due to a sensible heat change, so that a supercooled state is achieved (a state at a point C in FIG. 5). Meanwhile, the temperature at which the gas refrigerant is changed to the liquid refrigerant due to the latent heat change is high-pressure saturation temperature, and the high-pressure saturation temperature is temperature that corresponds to a pressure value (a pressure value P2 that is represented by "HPS" in FIG. 5) that is detected by the discharge pressure sensor 31. The temperature of the refrigerant in the supercooled state at an outlet of the condenser is the heat exchange outlet temperature, the heat exchange outlet temperature at the time of cooling operation of the air conditioner 1 is detected by the heat exchange outlet temperature sensor 35.

The expansion valve depressurizes the low-temperature and high-pressure refrigerant that has flown out of the condenser, so that a gas-liquid two-phase refrigerant in which gas and liquid are mixed is obtained (a refrigerant in a state at a point D in FIG. 5).

The evaporator performs heat exchange between the gas-liquid two-phase refrigerant that has flown in and air, and evaporates the refrigerant. In this case, in the evaporator, after the entire gas-liquid two-phase refrigerant turns into a gas refrigerant due to a latent heat change, temperature of the gas refrigerant increases due to a sensible heat change, so that the refrigerant enters in a superheated state (a state at a point A in FIG. 5) and is sucked into the compressor 11. Meanwhile, the temperature at which the liquid refrigerant is changed to the gas refrigerant due to the latent heat change is low-pressure saturation temperature. The low-pressure saturation temperature is temperature that corresponds to a pressure value (a pressure value P1 indicated by "LPS" in FIG. 5) that is detected by the suction pressure sensor 33. Further, the temperature of the refrigerant that is superheated by the evaporator and sucked into the compressor 11 is suction temperature. The suction temperature is detected by the suction temperature sensor 34.

Meanwhile, the degree of supercooling of the refrigerant that is in the supercooled state when the refrigerant flows out of the condenser may be calculated by subtracting the temperature (the heat exchange outlet temperature as described above) of the refrigerant at a refrigerant outlet of the heat exchanger that functions as a condenser from the high-pressure saturation temperature. Furthermore, the degree of suction superheat of the refrigerant that is in the superheated state when the refrigerant flows out of the evaporator may be calculated by subtracting the suction temperature from the low-pressure saturation temperature.

Configuration of Estimation Model

The estimation model is generated by using an arbitrary operating state quantity (feature value) among a plurality of operating state quantities, by using, for example, a multiple regression analysis method that is one kind of regression analysis methods. A plurality of simulation results (results of calculation that are obtained by reproducing a refrigerant circuit by numerical calculation, and calculating values of the operating state quantity with respect to changes of a remaining refrigerant amount (for example, a refrigerant shortage rate of 0%, a refrigerant shortage rate of 10%, a refrigerant shortage rate of 20%, . . . )) are analyzed by the multiple regression analysis method, and a plurality of regression equations are obtained. A regression equation, in which a P value (a value that indicates a degree of influence of the operating state quantity on accuracy of the generated estimation model (predetermined weight parameter)) is small and a correction R2 (a value that indicates accuracy of the generated estimation model) is maximized in a range from 0.9 to 1.0, among the regression equations is used as the estimation model. Here, the P value and the correction R2 are values that are related to accuracy of the estimation model when the estimation model is generated by the multiple regression analysis method, and the accuracy of the generated the estimation model increases as the P value decreases and as the correction R2 approaches 1.0.

As a result, if the refrigerant shortage rate is 0% to 30% at the time of cooling, for example, a regression equation in which the operating state quantities, such as the degree of supercooling of the refrigerant, the outdoor air temperature, the high-pressure saturation temperature, and the rotation speed of the compressor 11, are used as the feature values is adopted as the estimation model. If the refrigerant shortage rate is 40% to 70% at the time of cooling, for example, a regression equation in which the operating state quantities, such as the suction temperature, the outdoor air temperature, and the rotation speed of the compressor 11, are used as the feature values is adopted as the estimation model.

If the refrigerant shortage rate at the time of heating is 0% to 20%, for example, a regression equation in which the operating state quantities, such as the degree of opening of the outdoor unit expansion valve 14, the degree of supercooling of the indoor unit 3, and the rotation speed of the compressor 11 are used as the feature values is adopted as the estimation model. Although the outdoor unit 2 of the present embodiment does not include a subcool heat exchanger, if the subcool heat exchanger (hereinafter, also referred to as SC heat exchanger) is included, it may be possible to use, as the feature value, SC heat exchange outlet temperature that is the operating state quantity. Meanwhile, the degree of supercooling of the indoor unit 3 is the degree of supercooling of the refrigerant that flows out of the indoor heat exchanger 51 that functions as a condenser at the time of heating operation. the degree of supercooling of the indoor unit 3 is calculated such that (the high-pressure saturation temperature of the outdoor unit 2 (a value that is obtained by converting the pressure value detected by the discharge pressure sensor 31 of the compressor 11 to temperature)—the heat exchange outlet temperature of the indoor heat exchanger 51 (the detected temperature of the liquid-side refrigerant temperature sensor 61)). Here, the degree of supercooling of the indoor unit 3 is affected by external factors, such as outside temperature and indoor temperature, and therefore, if the operating state quantities (the outdoor air temperature and the indoor temperature) that reflect the external factors are included in the feature value, it is possible to improve estimation accuracy of the refrigerant shortage rate.

Further, if the refrigerant shortage rate at the time of heating is 30% to 70%, for example, a regression equation in which the operating state quantities, such as the degree of suction superheat (which is obtained by subtracting the low-pressure saturation temperature from the suction temperature) and the degree of opening of the outdoor unit expansion valve 14 are used as the feature values is adopted as the estimation model.

The estimation model of the present embodiment includes six estimation models to be described below (the first cooler estimation model 73A, the second cooler estimation model 73B, the third cooler estimation model 73C, the first heater estimation model 73D, the second heater estimation model 73E, and the third heater estimation model 73F). In the present embodiment, each of the estimation models as described above is generated by using a simulation result to be described later. Meanwhile, the estimation models may be stored in the air conditioner 1 (for example, stored in the storage unit 73 of the centralized controller 7) as in the present embodiment or may be stored in a server 120 that is connected to the air conditioner 1.

The first cooler estimation model 73A is an estimation model that is effective when, for example, the refrigerant shortage rate is in a low range, such as from 0% to 30% (a range in which the remaining refrigerant amount is large (first range)), and is a first regression equation that is able to estimate the refrigerant shortage rate with high accuracy. The first regression equation is, for example, ($\alpha 1\times$the degree of supercooling of the refrigerant)+($\alpha 2\times$the outdoor air temperature)+($\alpha 3\times$the high-pressure saturation temperature)+($\alpha 4\times$the rotation speed of the compressor 11)+$\alpha 5$. It is assumed that the coefficients $\alpha 1$ to $\alpha 5$ are determined when the estimation models are generated. The control unit 74 calculates the refrigerant shortage rate of the refrigerant circuit 6 at a current time by assigning the current degree of supercooling of refrigerant, the outdoor air temperature, the high-pressure saturation temperature, and the rotation speed of the compressor 11 at the current time, which are acquired by the acquisition unit 71, to the first regression equation. Meanwhile, the reason that the degree of supercooling of the refrigerant, the outdoor air temperature, the high-pressure saturation temperature, and the rotation speed of the compressor 11 are assigned is to use the feature values that are used to generate the first cooler estimation model 73A. The degree of supercooling of refrigerant can be calculated by, for example, subtracting the heat exchange outlet temperature from the high-pressure saturation temperature. The outdoor air temperature is detected by the outdoor air temperature sensor 36. The high-pressure saturation temperature is a value that is obtained by converting the pressure value detected by the discharge pressure sensor 31 to temperature. The rotation speed of the compressor 11 is detected by a rotation speed sensor (not illustrated) of the compressor 11.

The second cooler estimation model 73B is an estimation model that is effective when, for example, the refrigerant shortage rate is in a high range, such as from 40% to 70% (the remaining refrigerant amount is small (second range)), and is a second regression equation that is able to estimate the refrigerant shortage rate with high accuracy. The second regression equation is, for example, ($\alpha 11\times$the suction temperature)+($\alpha 12\times$ the outdoor air temperature)+($\alpha 13\times$the rotation speed of the compressor 11)+$\alpha 14$. It is assumed that the coefficients $\alpha 11$ to $\alpha 14$ are determined when the estimation model is generated. The control unit 74 calculates the refrigerant shortage rate of the refrigerant circuit 6 at a current time by assigning the suction temperature, the outdoor air temperature, and the rotation speed of the compressor 11 at the current time, which are acquired by the acquisition unit 71, to the second regression equation. Meanwhile, the reason that the suction temperature, the outdoor air temperature, and the rotation speed of the compressor 11 are assigned is to use the feature values that are used to generate the second cooler estimation model 73B. The suction temperature is detected by the suction temperature sensor 34. The outdoor air temperature is detected by the outdoor air temperature sensor 36. The rotation speed of the compressor 11 is detected by the rotation speed sensor (not illustrated) of the compressor 11.

Figure 6A:
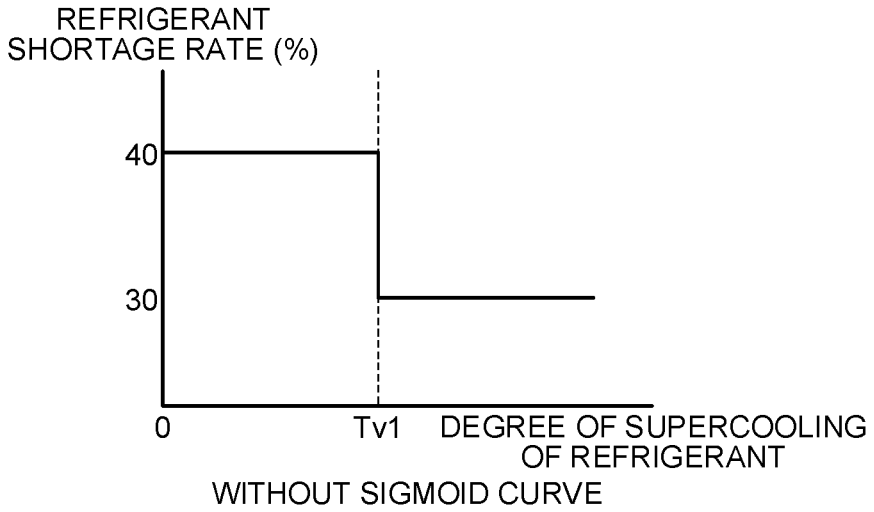
FIG. 6A is an explanatory diagram illustrating an example of in which an estimation result obtained by a first cooler estimation model and an estimation result obtained by a second cooler estimation model are not interpolated by a sigmoid curve.

Meanwhile, as described above, the refrigerant shortage rate that can be obtained by the first regression equation is 0% to 30%, and the refrigerant shortage rate that can be obtained by the second regression equation is 40% to 70%. In this case, when the refrigerant shortage rate is 30% to 40%, and if the first regression equation is used, the refrigerant shortage rate is calculated as 30%, whereas if the second regression equation is used, the refrigerant shortage rate is calculated as 40%. In other words, if the refrigerant shortage rate is 30% to 40%, both of the degree of supercooling of the refrigerant, which is highly contributable when the refrigerant shortage rate is equal to or smaller than 30%, and the suction temperature, which is highly contributable when the refrigerant shortage rate is equal to or larger than 40%, are less likely to change, so that it is difficult to generate an effective estimation model. Therefore, if the first regression equation or the second regression equation is used, the refrigerant shortage rate largely differs depending on the model to be used as illustrated in FIG. 6A.

The first cooler estimation model 73A and the second cooler estimation model 73B as described above can be used in a switching manner depending on the amount of refrigerant that remains in the refrigerant circuit 6. For example, immediately after installation of the air conditioner 1, it is possible to estimate that the refrigerant shortage rate is approximately zero, and therefore, the first cooler estimation model 73A is used. Further, if it is confirmed by the first cooler estimation model 73A that the refrigerant shortage rate is increasing, the estimation model is switched to the second cooler estimation model 73B. The switching between the estimation models as described above may be performed by the control unit of the air conditioner 1 or may be performed manually.

However, with use of the third cooler estimation model 73C as described below, it is possible to eliminate the need of switching between the estimation models.

Figure 6B:
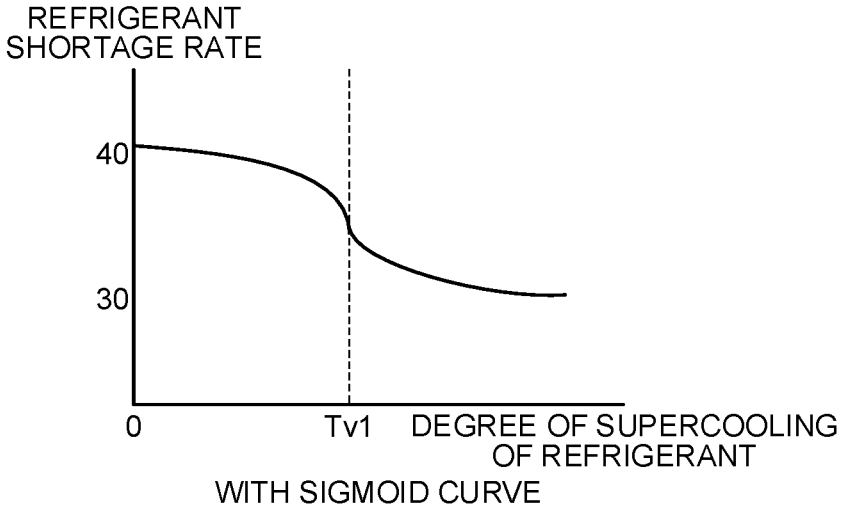
FIG. 6B is an explanatory diagram illustrating an example in which the estimation result obtained by the first cooler estimation model and the estimation result obtained by the second cooler estimation model are interpolated by a sigmoid curve.

The third cooler estimation model 73C is a cooling-period refrigerant shortage rate calculation formula that can cover the refrigerant shortage rate in a range of 0% to 70% that includes a range in which it is difficult to estimate the refrigerant shortage rate by using any of the first regression equation and the second regression equation as described above. The third cooler estimation model 73C is generated by combining the first cooler estimation model 73A and the second cooler estimation model 73B. Specifically, as illustrated in FIG. 6B, the third cooler estimation model 73C (cooling-period refrigerant shortage rate calculation formula) continuously connects a refrigerant shortage rate that is an estimation result obtained by the first cooler estimation model 73A (first regression equation) and a refrigerant shortage rate that is an estimation result obtained by the second cooler estimation model 73B (second regression equation), by a sigmoid curve using a sigmoid coefficient. More specifically, the cooling-period refrigerant shortage rate calculation formula is (the sigmoid coefficient×the refrigerant shortage rate obtained by the first regression equation)+((1−the sigmoid coefficient)×the refrigerant shortage rate obtained by the second regression equation). The control unit 74 calculates the refrigerant shortage rate of the refrigerant circuit 6 at a current time by assigning each of the refrigerant shortage rates, which are calculated by assigning the current operating state quantities that are acquired by the acquisition unit 71 to the first regression equation and the second regression equation, to the cooling-period refrigerant shortage rate calculation formula.

Here, the sigmoid coefficient is calculated by using any of the operating state quantities. In the present embodiment, by taking into account the fact that a result obtained by the first regression equation becomes approximately constant if the subcool reaches 0, a calculation formula is determined such that the sigmoid coefficient is 0.5 when the subcool is 5° C.

$$p=1/(1+\exp(-(sc-5)))$$

p: sigmoid coefficient sc: subcool value

If the sigmoid coefficient is determined as described above and the sigmoid coefficient is used for the third cooler estimation model 73C, the estimated value of the first cooler estimation model 73A is dominant in the estimated value obtained by the third cooler estimation model 73C when the refrigerant shortage rate is 0% to 30%, that is, when the refrigerant shortage rate is in the first range, and, the estimated value of the second cooler estimation model 73B is dominant in the estimated value obtained by the third cooler estimation model 73C when the refrigerant shortage rate is 40% to 70%, that is, when the refrigerant shortage rate is in the second range.

Meanwhile, the sigmoid coefficient need not always be calculated by the method as described above, but it is sufficient to determine the sigmoid coefficient such that when an actual refrigerant shortage rate is equal to or larger than 30%, that is, when the actual refrigerant shortage rate does not fall in the first range, the estimated value of the second cooler estimation model 73B becomes dominant in the estimated value obtained by the third cooler estimation model 73C, and when the actual refrigerant shortage rate is equal to or smaller than 40%, that is, when the actual refrigerant shortage rate does not fall in the second range, the estimated value of the first cooler estimation model 73A becomes dominant in the estimated value obtained by the third cooler estimation model 73C.

The first heater estimation model 73D is an estimation model that is effective when the refrigerant shortage rate is 0% to 20% (a range in which the remaining refrigerant amount is large (third range)), and is a fourth regression equation that is able to estimate the refrigerant shortage rate with high accuracy. The fourth regression equation is, for example, (α31×the degree of opening of the outdoor unit expansion valve 14)+(α32×the degree of supercooling of the indoor unit 3)+(α33×the rotation speed of the compressor 11)+α34. It is assumed that the coefficients α31 to α34 are determined when the estimation models are generated. The control unit 74 calculates the refrigerant shortage rate by assigning the current degree of opening of the outdoor unit expansion valve 14, the degree of supercooling of the indoor unit 3, and the rotation speed of the compressor 11, which are acquired by the acquisition unit 71, to the fourth regression equation. Meanwhile, the reason that the degree of opening of the outdoor unit expansion valve 14, the degree of supercooling of the indoor unit 3, and the rotation speed of the compressor 11 are assigned is that the degree of opening of the outdoor unit expansion valve 14 and the degree of supercooling of the indoor unit 3 at the time of heating operation are the operating state quantities that are affected by a change of the refrigerant amount when the refrigerant shortage amount is small (for example, a third range) and the rotation speed of the compressor 11 is the operating state quantity that is affected by the number of the indoor units that are operating. The operating state quantities (feature values) as described above are used when the first heater estimation model 73D is generated. The degree of opening of the outdoor unit expansion valve 14 is detected by a sensor (not illustrated). The rotation speed of the compressor 11 is detected by the rotation speed sensor (not illustrated) of the compressor 11. Meanwhile, the rotation speed of the compressor 11 may be acquired from the outdoor-side control unit. The degree of supercooling of the indoor unit 3 is calculated by, for example, subtracting the detected temperature of the liquid-side refrigerant temperature sensor 61 from the high-pressure saturation temperature of the outdoor unit 2. Here, the degree of supercooling of the indoor unit 3 is also affected by external factors, such as the outside temperature or the indoor temperature, and therefore, if the operating state quantities (the outdoor air temperature and the indoor temperature) that reflect the external factors (the outside temperature, the indoor temperature, and the like) are included in the feature value, it is possible to improve detection accuracy of the refrigerant shortage rate. For example, an estimation model (modified fourth regression equation) is (α31'×the degree of opening of the outdoor unit expansion valve 14)+(α32'×the degree of supercooling of the indoor unit 3)+(α33'×the outdoor air temperature)+(α34'×the SC heat exchange outlet temperature)+(α35'×the rotation speed of the compressor 11)+(α36'×the indoor temperature)+α37'). It is assumed that the coefficients α31' to α37' are determined when the estimation models are generated. The outdoor air temperature is detected by the outdoor air temperature sensor 36. The indoor temperature is detected by an indoor temperature sensor (not illustrated).

The second heater estimation model 73E is an estimation model that is effective when the refrigerant shortage rate is 30% to 70% (range in which the remaining refrigerant amount is small (fourth range)), and is a fifth regression equation that is able to estimate the refrigerant shortage rate with high accuracy. The fifth regression equation is, for example, (α41×the suction superheat)+(α42×the degree of opening of the outdoor unit expansion valve 14)+α43. It is assumed that the coefficients α41 to α43 are determined when the estimation models are generated. The control unit 74 calculates the refrigerant shortage rate of the refrigerant circuit 6 at a current time by assigning the current suction superheat and the degree of opening of the outdoor unit expansion valve 14, which are acquired by the acquisition unit 71, to the fifth regression equation. Meanwhile, the reason that the suction superheat and the degree of opening of the outdoor unit expansion valve 14 are assigned is that the suction superheat and the degree of opening of the outdoor unit expansion valve 14 at the time of heating operation are the operating state quantities that are affected by a change of the refrigerant amount when the refrigerant shortage amount is large (for example, a fourth range) and to use the feature values that are used to generate the second heater estimation model 73E. The suction superheat can be calculated by, for example, subtracting the low low-pressure saturation temperature (temperature corresponding to the pressure value detected by the suction pressure sensor 33) from the suction temperature (the detected value of the suction temperature sensor 34). The degree of opening of the outdoor unit expansion valve 14 is detected by a sensor (not illustrated).

Figure 7A:
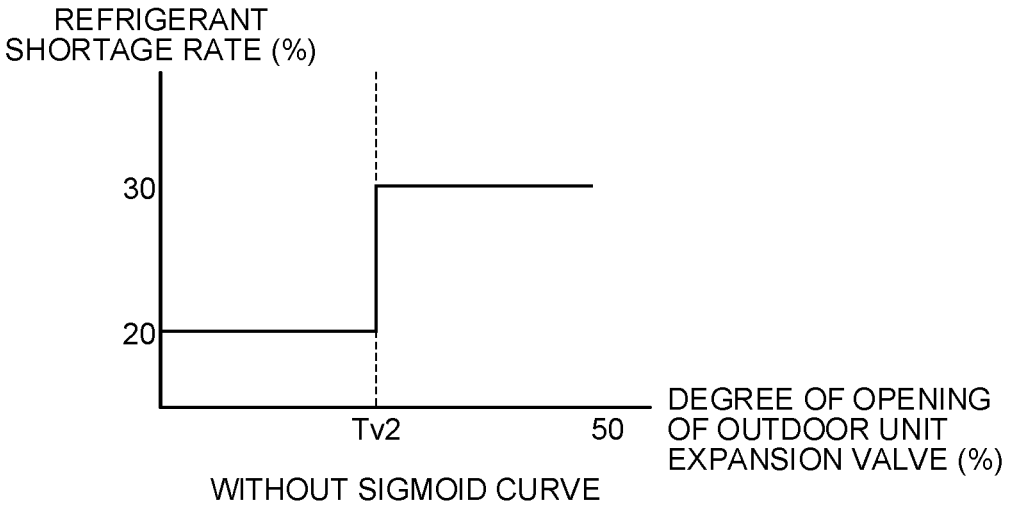
FIG. 7A is an explanatory diagram illustrating an example in which an estimation result obtained by a first heater estimation model and an estimation result obtained by a second heater estimation model are not interpolated by a sigmoid curve.

Further, as described above, the refrigerant shortage rate that is obtained by the fourth regression equation is, for example, 0% to 20%, and the refrigerant shortage rate that is obtained by the fifth regression equation is, for example, 30% to 70%. In this case, if the fourth regression equation is used in the air conditioner 1 in which the refrigerant shortage rate is in the range from 20% to 30%, the refrigerant shortage rate is calculated as 20%. Further, if the fifth regression equation is used in the same air conditioner 1, the refrigerant shortage rate is calculated as 30%. In other words, if the refrigerant shortage rate is 20% to 30%, all of the operating state quantities (the degree of opening of the outdoor unit expansion valve 14 and the degree of supercooling of the indoor unit 3), which are affected by a change of the refrigerant amount when the refrigerant shortage amount (refrigerant shortage rate) is small, and the operating state quantities (the degree of opening of the outdoor unit expansion valve 14 and the suction superheat), which are affected by a change of the refrigerant amount when the refrigerant shortage amount (refrigerant shortage rate) is large, are less likely to change, so that it is difficult to estimate a change of the refrigerant shortage rate between 20% and 30%. Therefore, if the fourth regression equation or the fifth regression equation is independently used, an attention needs to be paid to the fact that the refrigerant shortage rate differs depending on the model to be used as illustrated in FIG. 7A when the refrigerant shortage rate of the air conditioner 1 falls within the range from 20% to 30%.

The first heater estimation model 73D and the second heater estimation model 73E as described above can be used in a switching manner depending on the amount of refrigerant that remains in the refrigerant circuit 6. For example, immediately after installation of the air conditioner 1, it is possible to estimate that the refrigerant shortage rate is approximately zero, and therefore, it is possible to use the first heater estimation model 73D. Further, if it is confirmed by the first heater estimation model 73D that the refrigerant shortage rate is increasing, the estimation model is switched to the second heater estimation model 73E. The switching between the estimation models as described above may be performed by the control unit of the air conditioner 1 or may be performed manually.

Figure 7B:
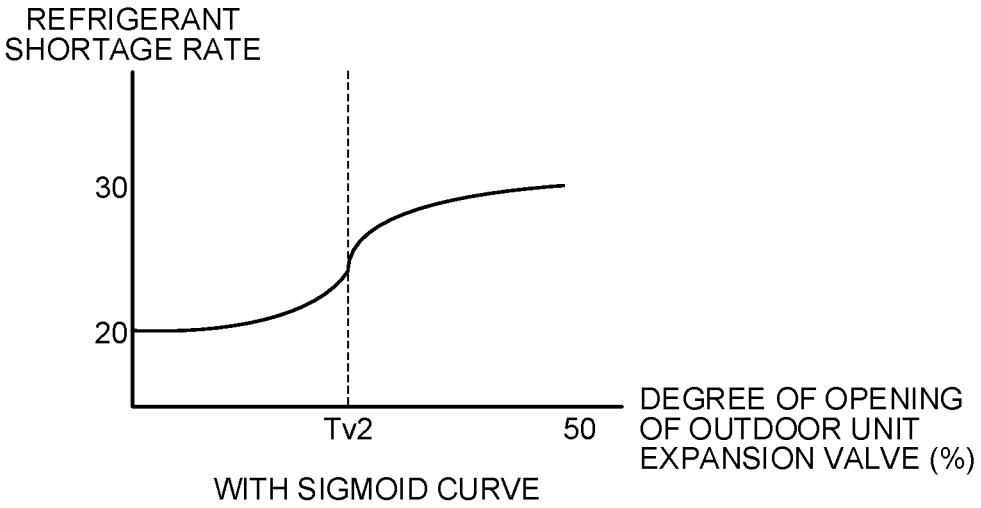
FIG. 7B is an explanatory diagram illustrating an example in which the estimation result obtained by the first heater estimation model and the estimation result obtained by the second heater estimation model are interpolated by a sigmoid curve.

However, with use of the third heater estimation model 73F as described below, it is possible to eliminate the need of switching between the estimation models. The third heater estimation model 73F is a heating-period refrigerant shortage rate calculation formula that can cover the refrigerant shortage rate in a range from 0% to 70% that includes a range in which it is difficult to estimate the refrigerant shortage rate by using any of the fourth regression equation and the fifth regression equation as described above. The third heater estimation model 73F is generated by combining the first heater estimation model 73D and the second heater estimation model 73E. Specifically, as illustrated in FIG. 7B, the third heater estimation model 73F (heating-period refrigerant shortage rate calculation formula) continuously connects a refrigerant shortage rate that is an estimation result obtained by the first heater estimation model 73D (fourth regression equation) and a refrigerant shortage rate that is an estimation result obtained by the second heater estimation model 73E (fifth regression equation), by a sigmoid curve using a sigmoid coefficient. More specifically, the heating-period refrigerant shortage rate calculation formula is (the sigmoid coefficient×the refrigerant shortage rate obtained by the fifth regression equation)+((1−the sigmoid coefficient)×the refrigerant shortage rate obtained by the fourth regression equation). The control unit 74 calculates the refrigerant shortage rate of the refrigerant circuit 6 at a current time by assigning each of the refrigerant shortage rates, which are calculated by assigning the current operating state quantities that are acquired by the acquisition unit 71 to the fourth regression equation and the fifth regression equation, to the heating-period refrigerant shortage rate calculation formula.

Here, the sigmoid coefficient is calculated by using any of the operating state quantities, in the same manner as in the cooling operation. In the present embodiment, a sigmoid coefficient p is calculated by using the degree of opening of the outdoor unit expansion valve 14. The degree of opening of the outdoor unit expansion valve 14 is an operating state quantity that is used in one of the fourth regression equation and the fifth regression equation for estimating the refrigerant shortage rate at the time of heating operation. For example, the sigmoid coefficient p is calculated from a calculation formula as described below based on the assumption that a degree D of opening of the outdoor unit expansion valve 14 is set such that D=0 in a fully-closed state and D=100 in a fully-opened state. The calculation formula described below is determined as a calculation formula in which the sigmoid coefficient p is 0.5 when the degree of opening of the outdoor unit expansion valve 14 is set to 90 by taking into account the fact that a result obtained the fourth regression equation becomes approximately constant if the degree of opening of the outdoor unit expansion valve 14 is set to full-open.

$$p = 1/(1 + \exp(-(D/10 - 45)))$$

p: sigmoid coefficient

D: degree of opening of the outdoor unit expansion valve 14

If the sigmoid coefficient is determined as described above and the sigmoid coefficient is used for the third heater estimation model 73F, the estimated value of the first heater estimation model 73D is dominant in the estimated value obtained by the third heater estimation model 73F when the refrigerant shortage rate is 0% to 20%, that is, when the refrigerant shortage rate is in the third range, and, the estimated value of the second heater estimation model 73E is dominant in the estimated value obtained by the third heater estimation model when the refrigerant shortage rate is 30% to 70%, that is, when the refrigerant shortage rate is in the fourth range.

Meanwhile, the sigmoid coefficient need not always be calculated by the method as described above, but it is sufficient to determine the sigmoid coefficient such that when an actual refrigerant shortage rate is equal to or larger than 20%, that is, when the actual refrigerant shortage rate does not fall in the third range, the estimated value of the second heater estimation model 73E becomes dominant in the estimated value obtained by the third heater estimation model 73F, and when the actual refrigerant shortage rate is equal to or smaller than 30%, that is, when the actual refrigerant shortage rate does not fall in the fourth range, the estimated value of the first heater estimation model 73D becomes dominant in the estimated value obtained by the third heater estimation model 73F.

As described above, at the time of cooling operation, it is possible to estimate the refrigerant shortage rate by using a regression expression (the first regression equation or the second regression equation) that corresponds to the refrigerant shortage rate. Further, it may be possible to estimate the refrigerant shortage rate by using the cooling-period refrigerant shortage rate calculation formula that includes the first regression equation and the second regression equation. When the first regression equation and the second regression equation are used separately, for example, the first regression equation is selected if the degree of supercooling of refrigerant at the time of cooling is a value that is larger than a first threshold (Tv1 in FIG. 6A and FIG. 6B). Furthermore, if the degree of supercooling of refrigerant at the time of cooling is equal to or smaller than the first threshold, the second regression equation is selected. If the value of the degree of supercooling of refrigerant at the time of cooling is around the first threshold, an estimated value of the refrigerant shortage rate discontinuously changes depending on the regression equation to be used. In contrast, if the cooling-period refrigerant shortage rate calculation formula that includes the first regression equation and the second regression equation is used, switching as described above is not needed. Moreover, if the cooling-period refrigerant shortage rate calculation formula that includes the first regression equation and the second regression equation is selected, it is possible to continuously estimate a change of the refrigerant shortage rate at the time of cooling even if the degree of supercooling of refrigerant is around the first threshold.

Furthermore, at the time of heating operation, it is possible to estimate the refrigerant shortage rate by using a regression expression (the fourth regression equation or the fifth regression equation) that corresponds to the refrigerant shortage rate. Moreover, it may be possible to estimate the refrigerant shortage rate by using the heating-period refrigerant shortage rate calculation formula that includes the fourth regression equation and the fifth regression equation. When the fourth regression equation and the fifth regression equation are used separately, for example, the fourth regression equation is selected if the degree of opening of the outdoor unit expansion valve 14 at the time of heating is smaller than a second threshold (Tv2 in FIG. 7A and FIG. 7B).

Furthermore, if the degree of opening of the outdoor unit expansion valve 14 at the time of heating is equal to or larger than the second threshold, the fifth regression equation is selected. If the value of the degree of opening of the outdoor unit expansion valve 14 at the time of heating is around the second threshold, an estimated value of the refrigerant shortage rate discontinuously changes depending on the regression equation to be used. In contrast, if the heating-period refrigerant shortage rate calculation formula that includes the fourth regression equation and the fifth regression equation is used, switching as described above is not needed. Moreover, if the heating-period refrigerant shortage rate calculation formula that includes the fourth regression equation and the fifth regression equation is selected, it is possible to continuously estimate a change of the refrigerant shortage rate at the time of heating even if the degree of opening of the outdoor unit expansion valve 14 is around the second threshold.

Operation of Estimation Process

Figure 9:
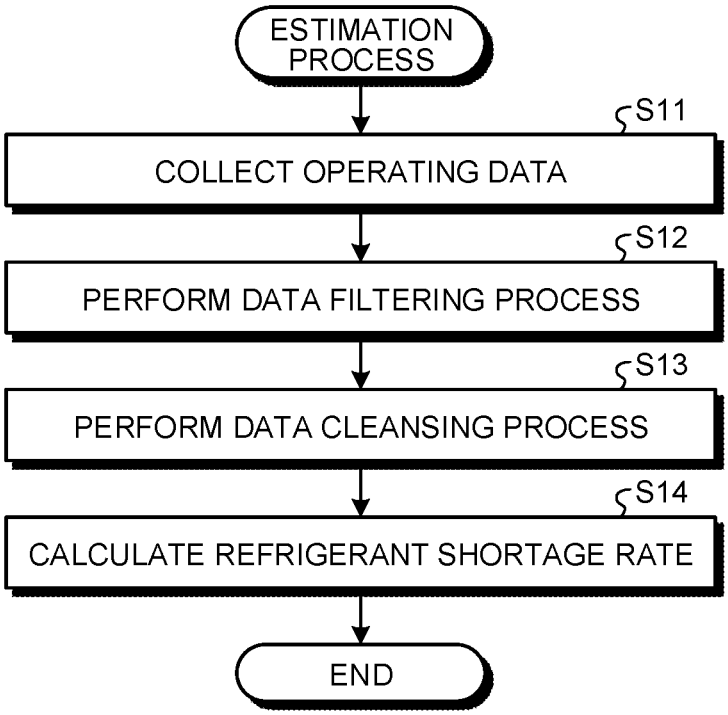
FIG. 9 is a flowchart illustrating an example of processing operation performed by the control circuit in relation to an estimation process.

FIG. 9 is a flowchart illustrating an example of processing operation performed by the control circuit 70 in relation to the estimation process. Meanwhile, it is assumed that the control circuit 70 stores therein the first cooler estimation model 73A, the second cooler estimation model 73B, the third cooler estimation model 73C, the first heater estimation model 73D, the second heater estimation model 73E, and the third heater estimation model 73F that are generated in advance. In FIG. 9, the control unit 74 in the control circuit 70 collects the operating state quantities as pieces of operating data via the acquisition unit 71 (Step S11). The control unit 74 performs a data filtering process for extracting an arbitrary operating state quantity from among the collected pieces of operating data (Step S12). The control unit 74 performs a data cleansing process (Step S13). The estimation unit 74A in the control unit 74 calculates the refrigerant shortage rate of the refrigerant circuit 6 at the current time by using each of the regression equations or each of the refrigerant shortage rate calculation formulas (Step S14), and the processing operation illustrated in FIG. 9 is terminated.

In the data filtering process, not all of the operating state quantities are used, but only a part of the operating state quantities that is needed to calculate the refrigerant shortage rate is extracted based on a predetermined filter condition from among the plurality of operating state quantities. By assigning the operating state quantity that is subjected to the data filtering process to each of the regression equations or each of the refrigerant shortage rate calculation formulas of the generated estimation model, it is possible to more accurately estimate the refrigerant shortage rate.

The predetermined filter condition includes a first filter condition, a second filter condition, and a third filter condition. The first filter condition is a filter condition for data that is extracted commonly among all of operating modes of the air conditioner 1, for example. The second filter condition is a filter condition for data that is extracted at the time of cooling operation. The third filter condition is a filter condition for data that is extracted at the time of heating operation.

The first filter condition is, for example, a driving state of the compressor 11, identification of an operating mode, elimination of special operation, elimination of a missing value with respect to an acquired value, elimination of a value for which a change amount is large (selection of a value for which a change amount is small) with respect to the operating state quantity that has a large influence at the time of generation of each of the regression equations, or the like. The driving state of the compressor 11 is an operating state quantity that is needed to estimate the refrigerant shortage rate. As a condition for estimating the refrigerant shortage rate, the compressor 11 needs to stably operate (a circulation amount of the refrigerant in the refrigerant circuit 6 needs to be stable). Therefore, the operating state quantity that is detected during a transition period, such as at the time of activation of the compressor 11, needs to be eliminated, and the data filtering process is arranged to eliminate the operating state quantity as described above.

The identification of the operating mode is a filter condition for extracting only an operating state quantity that is acquired at the time of cooling operation and at the time of heating operation. Therefore, an operating state quantity that is acquired during dehumidification operation or air supply operation is eliminated. The elimination of the special operation is a filter condition for eliminating an operating state quantity that is acquired during special operation, such as oil recovery operation or defrosting operation, in which the state of the refrigerant circuit 6 largely differs from the state at the time of cooling operation and at the time of heating operation. The elimination of the missing value is a filter condition for eliminating an operating state quantity that includes a missing value because when the operating state quantity that is used for determination of the refrigerant shortage rate includes a missing value, and if the operating state quantity is used to generate each of the regression equations, accuracy of each of the regression equations may be reduced.

The selection of the small value of the change amount of the operating state quantity that is assigned to each of the regression equations or each of the refrigerant shortage rate calculation formulas is a filter condition for extracting only an operating state quantity in a case where the operating state of the air conditioner 1 is stable (a state in which a circulation amount of the refrigerant in the refrigerant circuit 6 is stable), and is a condition that is needed to improve estimation accuracy using each of the regression equations and each of the refrigerant shortage rate calculation formulas. Meanwhile, the operating state quantity that largely affects estimation accuracy at the time of estimation of the refrigerant shortage rate is, for example, the degree of supercooling of the refrigerant that is used when the refrigerant shortage rate is low (for example, when 0% to 30%) at the time of cooling operation, the suction temperature that is used when the refrigerant shortage rate is high (for example, when 40% to 70%) at the time of cooling operation, the degree of supercooling of the indoor unit 3 that is used when the refrigerant shortage rate is low (for example, when 0% to 20%) at the time of heating operation, the suction superheat that is used when the refrigerant shortage rate is high (for example, when 30% to 70%) at the time of heating operation, or the like.

The second filter condition includes, for example, elimination of the heat exchange outlet temperature, abnormality of the subcool, abnormality of the discharge temperature, or the like.

The elimination of the heat exchange outlet temperature is a filter condition that takes into account the fact that, because the outdoor air temperature sensor 36 and a heat exchange outlet temperature sensor 35 are located close to each other, the heat exchange outlet temperature detected by the heat exchange outlet temperature sensor 35 at the time of cooling operation does not become lower than the outdoor air temperature detected by the outdoor air temperature sensor 36, and is a filter condition for eliminating the heat exchange outlet temperature that is lower than the outdoor air temperature.

The abnormality of the subcool is a filter condition for eliminating a degree of supercooling of the refrigerant that is abnormally high or abnormally low because a cooling load is extremely large or small when the degree of supercooling of the refrigerant as described above is detected. The abnormality of the discharge temperature is a filter condition for eliminating discharge temperature that is detected when what is called an out-of-gas state is detected in which the amount of refrigerant that is sucked into the compressor 11 is reduced due to a small cooling load.

The third filter condition is, for example, abnormality of the discharge temperature or the like. When the discharge temperature increases due to a large heating load at the time of heating operation and discharge temperature protection control is performed, the rotation speed of the compressor 11 is reduced to reduce the discharge temperature, and, the third filter condition is a filter condition for eliminating the discharge temperature that is detected at this time.

The data cleansing process is a process for eliminating an operating state quantity that may lead to erroneous estimation, instead of using all of the acquired operating state quantities for estimation of the refrigerant shortage rate. Specifically, the acquired operating state quantities may be smoothed to perform noise control, data amount limitation, or the like. The noise control based on the data smoothing is a process of preventing noise by calculating averages in a subject interval and calculating a moving average of the degree of supercooling of the refrigerant, the suction temperature, and the degree of suction superheat in each of the models, for example. The data amount limitation is a process for eliminating data whose amount is small, because reliability of such data is low, for example. For example, if the number of pieces of data that remain after the filtering process is performed on pieces of input data corresponding to one day is equal to or larger than X, the data is used for estimation of the refrigerant shortage rate, and if the number of pieces of data is smaller than X, all pieces of the data corresponding to the day are not used. In other words, in the data cleansing process, it is possible to more accurately estimate the refrigerant shortage rate by assigning the operating state quantities, from which the abnormal value and the outlier are eliminated, to each of the regression equations or each of the refrigerant shortage rate calculation formulas of the estimation model.

Sensor Value Editing Process

Further, various issues needs to be addressed to use the operating state quantity that is detected by the sensor of the indoor unit 3 in the estimation model. For example, when the plurality of indoor units 3 are connected to the outdoor unit 2, the operating indoor unit 3 and the stopped indoor unit 3 may be mixed in the plurality of indoor units 3. Therefore, the estimation model is used by using the operating state quantity that is detected by the sensor of each of the indoor units 3 while taking into account the situation as described above.

Furthermore, when the first heater estimation model 73D is used by using the degree of supercooling of the indoor unit 3, the degree of supercooling of the indoor unit 3 is calculated by using the detected temperature of the liquid-side refrigerant temperature sensor 61 of the indoor unit 3 and the high-pressure saturation temperature of the outdoor unit 2. Meanwhile, the high-pressure saturation temperature of the outdoor unit 2 is a value that is converted by the sensor value of the discharge pressure sensor 31 in the outdoor unit 2.

However, the detected temperature of the liquid-side refrigerant temperature sensor 61 of each of the operating indoor units 3 and the sensor value of the discharge pressure sensor 31 of the outdoor unit 2 change due to an influence of indoor temperature or outdoor temperature. In this case, to accurately calculate the degree of supercooling of the indoor unit 3, it is needed to use sensor values (hereinafter, also referred to as sensor values at around the same detection time) for which the detection times of the sensor values (the detected temperature of the liquid-side refrigerant temperature sensor 61 of the indoor unit 3 and the pressure value of the discharge pressure sensor 31 of the outdoor unit 2) are as close as possible. Therefore, a mechanism that can obtain the detected temperature of the liquid-side refrigerant temperature sensor 61 and the pressure value of the discharge pressure sensor 31 at around the same detection time is needed.

To cope with this, in the present embodiment, a sensor value editing process for acquiring, in an associated manner, the sensor value of the discharge pressure sensor 31 of the outdoor unit 2 and the sensor value of the liquid-side refrigerant temperature sensor 61 of the indoor unit 3 at around the same detection time is needed.

FIG. 8 is an explanatory diagram illustrating an example of the sensor value editing process. The sensor value editing process illustrated in FIG. 8 is, for example, a process that is performed by the control circuit 70 of the centralized controller 7. Meanwhile, for convenience of explanation, explanation will be given based on the assumption that the three indoor units 3 among the plurality of indoor units 3 are operating. The operating indoor units 3 will be described as, for example, an "indoor unit "#1"", an "indoor unit "#2"" and an "indoor unit "#3"".

The outdoor-side control unit 19C transfers the outdoor-side detection result that is stored in the outdoor-side storage unit 19B to the centralized controller 7. Further, the indoor-side control unit 65C transfers the indoor-side detection result that is stored in the indoor-side storage unit 65B to the centralized controller 7 via the outdoor unit controller 19. The detection result is transferred from each of the indoor units 3 or the outdoor unit 2 to the centralized controller 7 only when the detection result (sensor value) is changed. For example, if there is any change in the outdoor-side control unit 19C or the indoor-side control unit 65C based on comparison between a previous detection result and a current detection result (for example, an operating mode is changed, ON and OFF of operation is changed, temperature of the sensor is changed, or the like), the detection result is transferred to the centralized controller 7. The detection result that is transferred to the centralized controller 7 is associated with a time (detection time) at which the change of the detection result is detected in each of the indoor units 3 or the outdoor unit 2.

In the present embodiment, an example will be described in which the acquisition unit 71 in the control circuit 70 of the centralized controller 7 acquires a sensor value that is detected by the discharge pressure sensor 31 and a detection time of the sensor value from the outdoor unit 2. Further, an example will be described in which a sensor value detected by the liquid-side refrigerant temperature sensor 61 and a detection time of the sensor value are acquired from each of the indoor units 3. A left figure in FIG. 8 illustrates sensor values that are not subjected to the sensor value editing process, and a right figure illustrates sensor values that are subjected to the sensor value editing process.

As illustrated in the left figure in FIG. 8, the control unit 74 in the control circuit 70 acquires detection times and each of sensor values at each of the detection times, and sequentially stores the acquired detection times and the sensor values. To reduce a communication traffic, each of the indoor units 3 and the outdoor unit 2 transfers the detection result to the centralized controller 7 when the detection result is changed. Therefore, an interval at which the centralized controller 7 acquires the detection result from each of the indoor units 3 and the outdoor unit 2 is irregular. Thus, "sensor value is changed" in FIG. 8 indicates a case in which the sensor value at the detection time is changed as compared to a previous sensor value (the centralized controller 7 has acquired the detection result from each of the indoor units 3 or the outdoor unit 2). Further, "unchanged" in FIG. 8 indicates a case in which the sensor value at the detection time is not changed as compared to the previous sensor value (the centralized controller 7 has not acquired the detection result from each of the indoor units 3 or the outdoor unit 2). The control unit 74 is able to recognize each of the sensor values of the outdoor unit 2 and the indoor unit 3 at each of the detection times by referring to the details as stored in the left figure.

The control unit 74 generates a data set in the entire air conditioner 1 (unit) based on the sensor values of the outdoor unit 2 and each of the indoor units 3 at each of the detection times in the left figure. The data set includes a time that is marked at predetermined time intervals (for example, at intervals of five minutes) (for example, "processed time" in FIG. 8, hereinafter, also referred to as a representative time), and each of representative sensor values that are associated with the representative times. For example, a sensor value that is detected until the representative time five minutes from a predetermined representative time is determined as a sensor value around the representative time, the data set is generated by sequentially editing the sensor values around each of the representative times, and the data set is stored.

For example, a case will be determined in which a sensor value (representative sensor value) at a representative time of "0:05" is determined. In a period from a time of "0:00" to the time of "0:05", the control unit 74 acquires sensor values at detection times of "0:00", "0:01", and "0:03". In contrast, at each of times of "0:02" and "0:04", all of sensor values are not changed, and therefore, the control unit 74 does not acquire the sensor values. Therefore, the control unit 74 determines the representative sensor value by using each of the sensor values at the detection times of "0:00", "0:01", and "0:03" around the representative time of "0:05". For example, when determining the representative sensor value of the outdoor unit 2 at the representative time of "0:05", the control unit 74 first determines whether "sensor value is changed" is present among the sensor values of the outdoor unit 2 at the detection times of "0:00", "0:01", and "0:03". Subsequently, if "sensor value is changed" is present, the control unit 74 determines, as the representative sensor value of the outdoor unit 2 at the representative time of "0:05", the sensor value indicated by "sensor value is changed" at "0:00" that is the earliest time among the sensor values at the detection times, for example. Similarly, when determining the representative sensor value of the "indoor unit #1" at the representative time of "0:05", the control unit 74 first determines whether "sensor value is changed" is present among the sensor values of the "indoor unit #1" at the detection times of "0:00", "0:01", and "0:03". Subsequently, if "sensor value is changed" is present, the control unit 74 determines, as the representative sensor value of the "indoor unit #1" at the representative time of "0:05", the sensor value indicated by "sensor value is changed" at the earliest time among the sensor values at the detection times, for example. Similarly, when determining the representative sensor value of the "indoor unit #2" at the representative time of "0:05", the control unit 74 first determines whether "sensor value is changed" is present among the sensor values of the "indoor unit #2" at the detection times of "0:00", "0:01", and "0:03". Subsequently, if "sensor value is changed" is present, the control unit 74 determines, as the representative sensor value of the "indoor unit #2" at the representative time of "0:05", the sensor value indicated by "sensor value is changed" at the earliest time among the sensor values at the detection times, for example. Similarly, when determining the representative sensor value of the "indoor unit #3" at the representative time of "0:05", the control unit 74 first determines whether "sensor value is changed" is present among the sensor values of the "indoor unit #3" at the detection times of "0:00", "0:01", and "0:03". Subsequently, if "sensor value is changed" is present, the control unit 74 determines, as the representative sensor value of the "indoor unit #3" at the representative time of "0:05", the sensor value indicated by "sensor value is changed" at the earliest time among the sensor values at the detection times, for example.

A case in which the control unit 74 determines the representative sensor value at a representative time of "0:10" will be described as an example. The control unit 74 determines the representative sensor value by using each of the sensor values at detection times of "0:06" and "0:09" around the representative time of "0:10". For example, when determining the representative sensor value of the outdoor unit 2 at the representative time of "0:10", the control unit 74 first determines whether "sensor value is changed" is present among the sensor values of the outdoor unit 2 at the detection times of "0:06" and "0:09", for example. Subsequently, because "sensor value is changed" is absent, the control unit 74 adopts the sensor value of the outdoor unit 2 at the previous representative time of "0:05" as a "previous sensor value" in place of the sensor value indicated by "unchanged", and determines this sensor value as the representative sensor value of the outdoor unit 2 at the representative time of "0:10". Similarly, when determining the representative sensor value of the "indoor unit #1" at the representative time of "0:10", the control unit 74 determines whether "sensor value is changed" is present among the sensor values of "indoor unit #1" at the detection times of "0:06" and "0:09" around the representative time of "0:10", for example. Subsequently, because "sensor value is changed" is absent, the control unit 74 adopts the sensor value of the "indoor unit #1" at the previous representative time of "0:05" as a "previous sensor value" in place of the sensor value indicated by "unchanged", and determines this sensor value as the representative sensor value of the "indoor unit #1" at the representative time of "0:10". Further, when determining the representative sensor value of the "indoor unit #2" at the representative time of "0:10", the control unit 74 determines whether "sensor value is changed" is present among the sensor values of the "indoor unit #2" at the detection times of "0:06" and "0:09" around the representative time of "0:10", for example. Subsequently, if "sensor value is changed" is present, the control unit 74 determines, as the representative sensor value of the "indoor unit #2" at the representative time of "0:10", the sensor value indicated by "sensor value is changed" at the earliest time among the sensor values at the detection times, for example. Furthermore, when determining the representative sensor value of the "indoor unit #3" at the representative time of "0:10", the control unit 74 determines whether "sensor value is changed" is present among the sensor values of the "indoor unit #3" at the detection times of "0:06" and "0:09" around the representative time of "0:10". Subsequently, if "sensor value is changed" is present, the control unit 74 determines, as the representative sensor value of the "indoor unit #3" at the representative time of "0:10", the sensor value indicated by "sensor value is changed" at the earliest time among the sensor values at the detection times, for example.

A case in which the control unit 74 determines the representative sensor value at a representative time of "0:15" will be described as an example. In a period from a time of "0:11" to the time of "0:15", the control unit 74 has not acquired sensor values because all of sensor values have not changed. Therefore, each of the sensor values is not present around the representative time of "0:15". In this case, each of the representative sensor values at the previous representative time of "0:10" is determined as the representative sensor value at the representative time of "0:15".

For example, a case will be described in which the representative sensor value at a representative time of "0:30" is determined. The control unit 74 determines the representative sensor value by using each of the sensor values at detection times of "0:27" and "0:28" around the representative time of "0:30". For example, when determining the representative sensor value of the outdoor unit 2 at the representative time of "0:30", the control unit 74 first determines whether "sensor value is changed" is present among the sensor values of the outdoor unit 2 at the detection times of "0:27" and "0:28". Subsequently, because "sensor value is changed" is absent, the control unit 74 adopts the sensor value of the outdoor unit 2 at the previous representative time of "0:25" as a "previous sensor value" in place of the sensor value indicated by "unchanged", and determines this sensor value as the representative sensor value of the outdoor unit 2 at the representative time of "0:30".

Further, when determining the representative sensor value of the "indoor unit #1" at the representative time of "0:30", the control unit 74 determines whether "sensor value is changed" is present among the sensor values of "indoor unit #1" at the detection times of "0:27" and "0:28" around the representative time of "0:30", for example. Subsequently, because "sensor value is changed" is absent, the control unit 74 adopts the sensor value of the "indoor unit #1" at the previous representative time of "0:25" as a "previous sensor value" in place of the sensor value indicated by "unchanged", and determines this sensor value as the representative sensor value of the "indoor unit #1" at the representative time of "0:30". Furthermore, when determining the representative sensor value of the "indoor unit #2" at the representative time of "0:30", the control unit 74 determines whether "sensor value is changed" is present among the sensor values of the "indoor unit #2" at the detection times of "0:27" and "0:28" around the representative time of "0:30", for example. Subsequently, if "sensor value is changed" is present, the control unit 74 determines, as the representative sensor value of the "indoor unit #2" at the representative time of "0:30", the sensor value indicated by "sensor value is changed" at the earliest time among the sensor values at the detection times, for example. Moreover when determining the representative sensor value of the "indoor unit #3" at the representative time of "0:30", the control unit 74 determines whether "sensor value is changed" is present among the sensor values of the "indoor unit #3" at the detection times of "0:27" and "0:28" around the representative time of "0:30". If "sensor value is changed" is present, the control unit 74 determines, as the representative sensor value of the "indoor unit #3" at the representative time of "0:30", the sensor value indicated by "sensor value is changed" at the earliest time among the sensor values at the detection times, for example.

The control unit 74 edits the sensor values of the outdoor unit 2 and each of the indoor units 3 at each of the representative times, and stores the edited sensor values of the outdoor unit 2 and each of the indoor units 3 as the representative sensor values. Meanwhile, the control unit 74 deletes unneeded sensor values other than the edited sensor values of the outdoor unit 2 and the indoor unit 3 from the storage unit. In this manner, the operating data of the air conditioner 1 is collected.

Meanwhile, the collected operating data is subjected to the data the filtering process and the data cleansing process as illustrated in FIG. 9 and then used for calculation of the refrigerant shortage rate.

Figure 10:
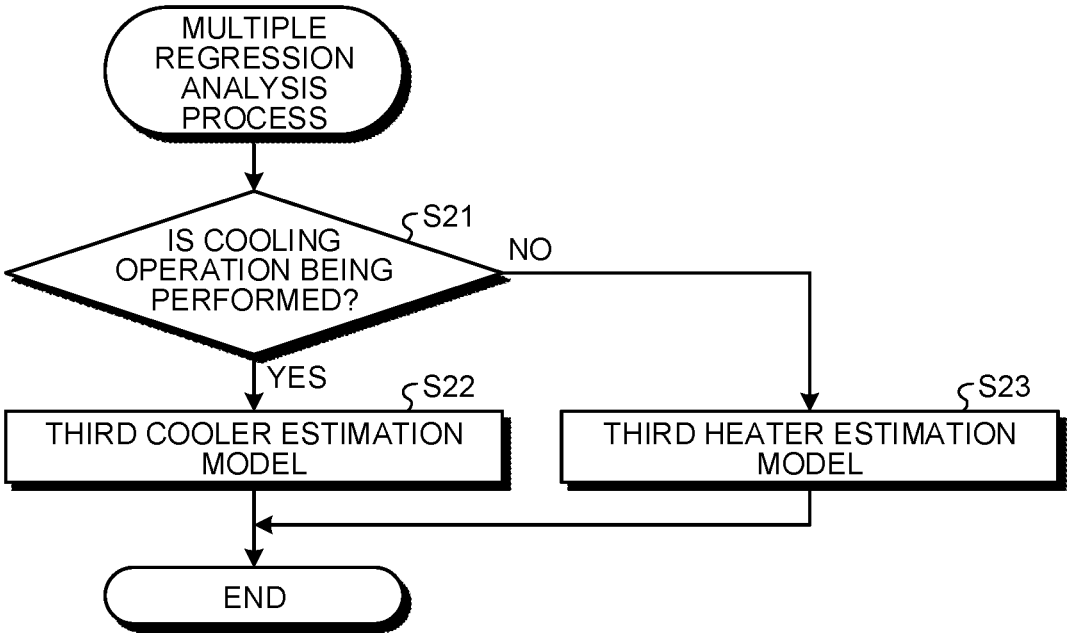
FIG. 10 is a flowchart illustrating an example of processing operation performed by the control circuit in relation to a multiple regression analysis process.

For example, a case will be described in which the refrigerant shortage rate is calculated by using the third heater estimation model 73F. In this case, the representative sensor values of the outdoor unit 2 and the indoor unit 3 at the representative time are referred to, and the degree of supercooling or the like is calculated by using an average value of the representative sensor values of the respective indoor units #1, #2, and #3. For example, the control unit 74, when adopting the sensor value of the discharge pressure sensor 31 as the sensor value of the outdoor unit 2 and adopting the sensor value of the liquid-side refrigerant temperature sensor 61 as the sensor value of each of the indoor units 3, refers to the sensor value of the discharge pressure sensor 31 and the sensor value of the liquid-side refrigerant temperature sensor 61 around the representative time and obtains the representative sensor value in each of the indoor units 3. Further, to calculate the high-pressure saturation temperature at the representative time based on the representative sensor value of the discharge pressure sensor 31 at the representative time, the control unit 74 calculates the degree of supercooling of the indoor unit 3 at each of the representative times based on an average value of the representative sensor value of the discharge pressure sensor 31 at the representative time and the representative sensor value of the liquid-side refrigerant temperature sensor 61 of each of the indoor units 3. Furthermore, the control unit 74 is able to calculate the refrigerant shortage rate of the refrigerant circuit 6 at the representative time by using the calculated degree of supercooling of the indoor unit 3 at the representative time or the like and the third heater estimation model 73F. The control circuit 70 illustrated in FIG. 10 determines whether or not the cooling operation is being performed presently (Step S21). In a case where the cooling operation is being performed presently (Step S21: Yes), the control circuit 70 substitutes the present operation state quantities into the third cooler estimation model 73C (Step S22), and the processing operation illustrated in FIG. 10 is terminated. In a case where the cooling operation is not being performed presently (Step S21: No), the control circuit 70 substitutes the present operation state quantities into the third heater estimation model 73F (Step S23), and the processing operation illustrated in FIG. 10 is terminated.

Method of Generating Regression Equations

A feature value that is used to generate the first to the sixth regression equations will be described below. At the time of cooling operation in which the first to the third regression equations are used, each of the operating state quantities, such as the degree of supercooling of refrigerant, the outdoor air temperature, the high-pressure saturation temperature, the rotation speed of the compressor 11, and the suction temperature, is used as the feature value that is used to generate the first to the sixth regression equation by the multiple regression analysis method, for example. Further, as each of the operating state quantities as described above, a result obtained by a simulation is used. Furthermore, at the time of heating operation in which the fourth to the sixth regression equation are used, as the feature value in the multiple regression analysis method, for example, each of the operating state quantities, such as the degree of supercooling of the indoor unit 3, the indoor temperature, the suction superheat, the outdoor air temperature, the rotation speed of the compressor 11, and the degree of opening of the outdoor unit expansion valve 14, is used. Moreover, as each of the operating state quantities as described above, a result obtained by a simulation is used.

Specifically, as one example, simulations are performed while changing outdoor air temperature when the four indoor units 3 are operating at a design stage of the air conditioner 1, and a relationship between the feature value and the refrigerant shortage rate is acquired for each of the simulations. As a condition at the time of performing the simulations, for example, the outdoor air temperature is changed to 20° C., 25° C., 30° C., 35° C., and 40° C. Meanwhile, when the simulations are performed, it may be possible to add a different parameter other than the outdoor air temperature, and it may be possible to change the number of the operating indoor units 3 to one to four, for example.

Figure 11:
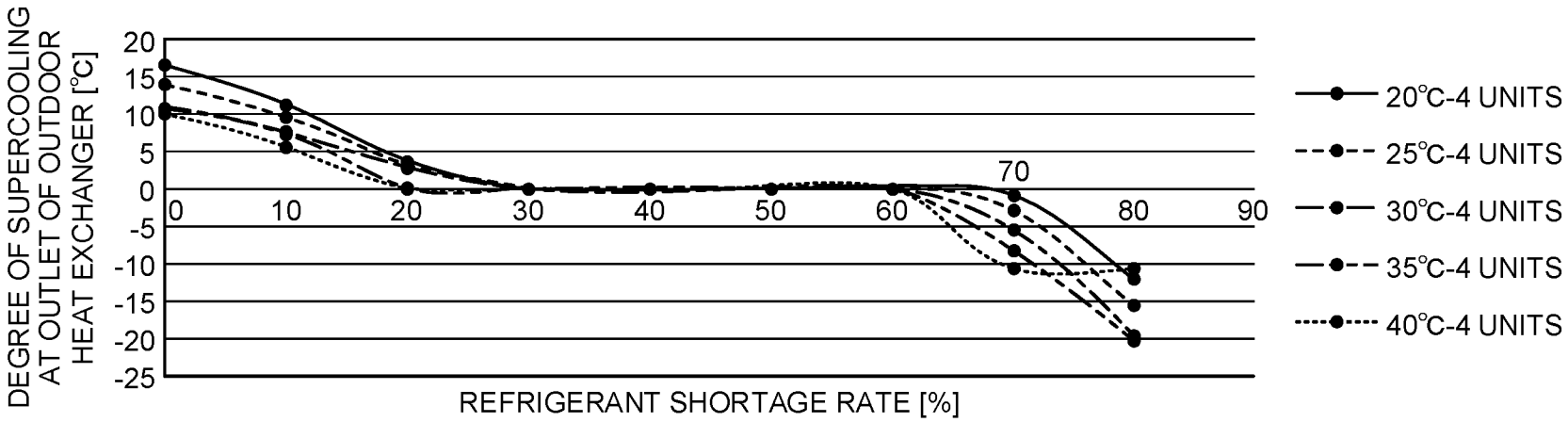
FIG. 11 is an explanatory diagram illustrating an example of a simulation result of a relationship between a degree of supercooling of refrigerant at a refrigerant outlet side of an outdoor heat exchanger at the time of cooling operation and a refrigerant shortage rate.

FIG. 11 is an explanatory diagram illustrating an example of a simulation result of a relationship between the degree of supercooling of refrigerant at the refrigerant outlet side of the outdoor heat exchanger at the time of cooling operation and the refrigerant shortage rate. The degree of supercooling of refrigerant illustrated in FIG. 11 decreases while the refrigerant shortage rate changes from 0% to 30%, and remains unchanged while the refrigerant shortage rate changes from 30% to 60%. In other words, if the refrigerant shortage rate is 0 to 30% at the time of cooling operation, the shortage of the refrigerant amount in the refrigerant circuit 6 largely affects the value of the degree of supercooling of refrigerant. Meanwhile, in FIG. 11, the degree of supercooling of refrigerant at the refrigerant shortage rate of 60% or more has a negative value, but this value appears only in the simulations because, in reality, the degree of supercooling of refrigerant does not become less than 0° C. Therefore, the degree of supercooling of refrigerant at the refrigerant shortage rate of 60% or more is not used for generation of regression equations.

Figure 12:
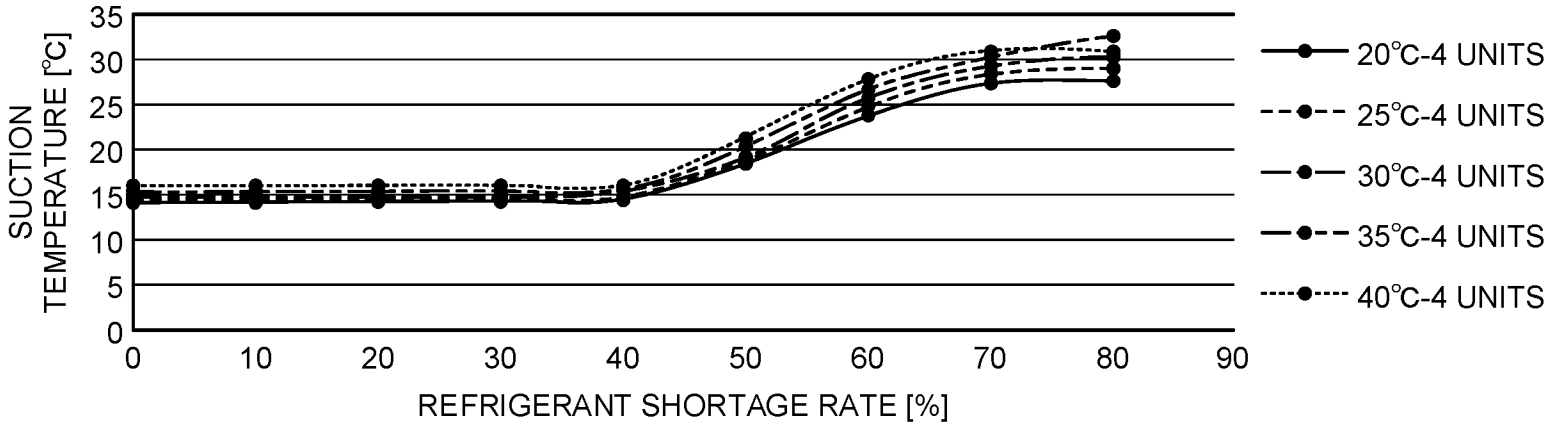
FIG. 12 is an explanatory diagram illustrating an example of a simulation result of a relationship between suction temperature at the time of cooling operation and the refrigerant shortage rate.

FIG. 12 is an explanatory diagram illustrating an example of a simulation result of a relationship between the suction temperature at the time of cooling operation and the refrigerant shortage rate. The suction temperature illustrated in FIG. 12 tends to increase when the refrigerant shortage rate is 40 to 70%. In other words, if the refrigerant shortage rate is 40 to 70% at the time of cooling operation, the shortage of the refrigerant amount in the refrigerant circuit 6 largely affects the value of the suction temperature. Meanwhile, in FIG. 12, the suction temperature at the refrigerant shortage rate of 70% or more little changes, and therefore, it is difficult to estimate a higher refrigerant shortage rate by the suction temperature. Therefore, the suction temperature at the refrigerant shortage rate of 70% or more is not used for generation of regression equations.

Figure 13:
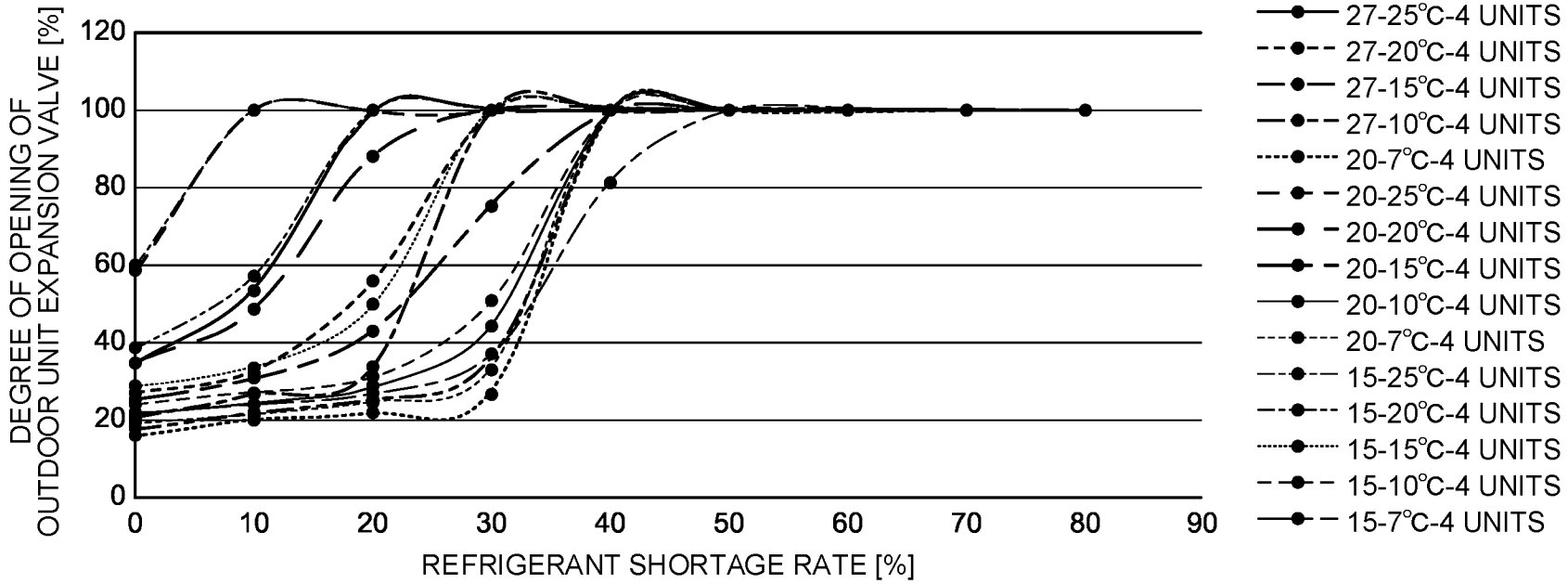
FIG. 13 is an explanatory diagram illustrating an example of a simulation result of a relationship between a degree of opening of an outdoor unit expansion valve at the time of heating operation and the refrigerant shortage rate.

FIG. 13 is an explanatory diagram illustrating an example of a simulation result of a relationship between the degree of opening of the outdoor unit expansion valve 14 at the time of heating operation and the refrigerant shortage rate. The degree of opening of the outdoor unit expansion valve 14 illustrated in FIG. 13 changes at the refrigerant shortage rate of 0 to 20%, but the degree of opening of the outdoor unit expansion valve 14 little changes when the refrigerant shortage rate exceeds 20%. In other words, the refrigerant shortage rate at the time of heating operation is 0 to 20%, the shortage of the refrigerant amount in the refrigerant circuit 6 largely affects the degree of opening of the outdoor unit expansion valve 14. Meanwhile, as described above, when the refrigerant shortage rate exceeds 20%, the degree of opening of the outdoor unit expansion valve 14 little changes. Therefore, the degree of opening of the outdoor unit expansion valve 14 at the refrigerant shortage rate of 20% or more is not used for generation of regression equations.

Figure 14:
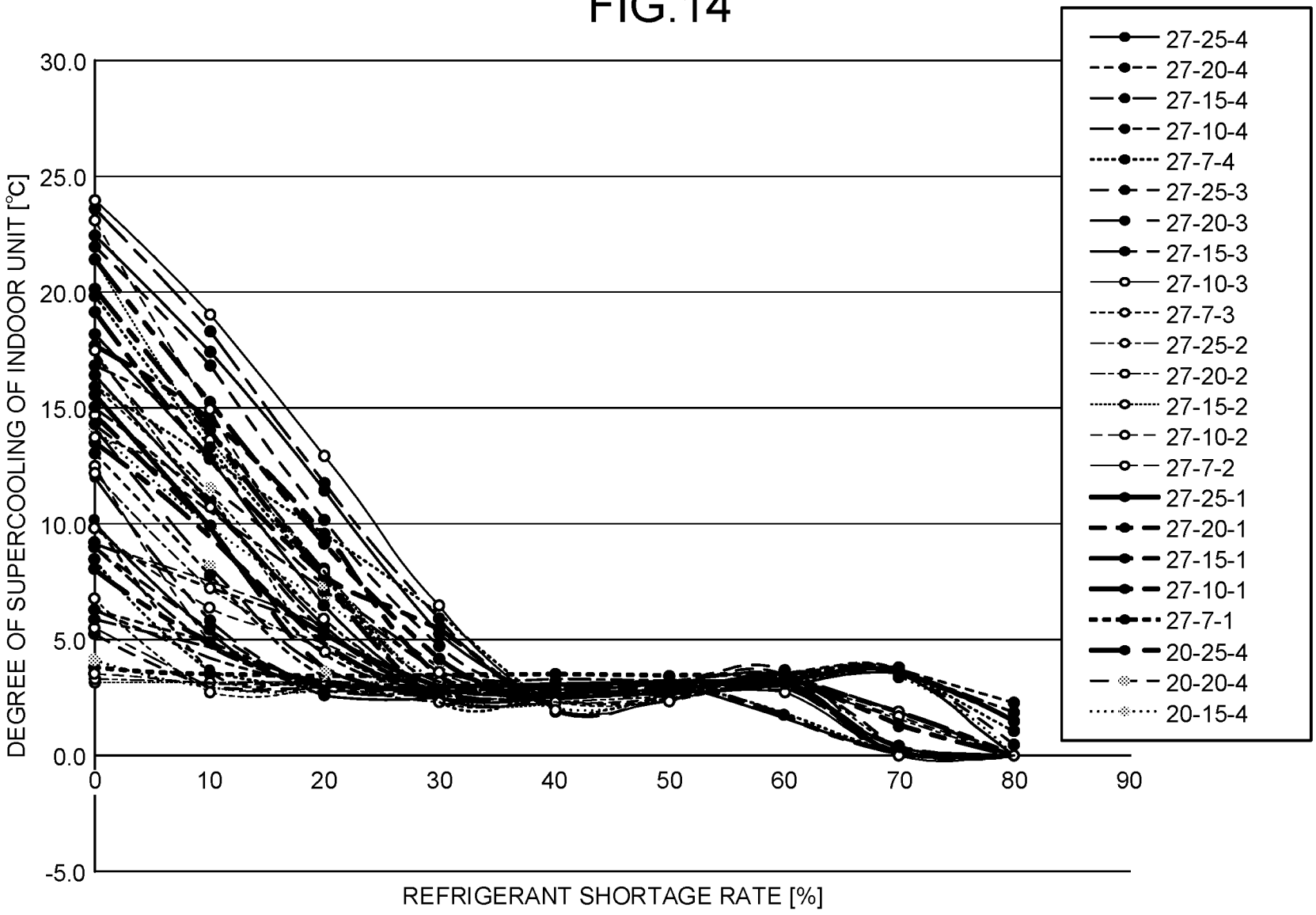
FIG. 14 is an explanatory diagram illustrating an example of a simulation result of a relationship between a degree of supercooling of an indoor unit 3 at the time of heating operation and the refrigerant shortage rate.

FIG. 14 is an explanatory diagram illustrating an example of a simulation result of a relationship between the degree of supercooling of the indoor unit 3 at the time of heating operation and the refrigerant shortage rate. The degree of supercooling of the indoor unit 3 illustrated in FIG. 14 changes at the refrigerant shortage rate of 0 to 35%, but the degree of supercooling little changes when the refrigerant shortage rate exceeds 35%. In other words, in a region in which the refrigerant shortage rate at the time of heating operation is low (for example, 0 to 20%), the shortage of the refrigerant amount in the refrigerant circuit 6 largely affects the degree of supercooling of the indoor unit 3. Meanwhile, as described above, when the refrigerant shortage rate exceeds 35%, the degree of supercooling of the indoor unit 3 little changes.

Figure 15:
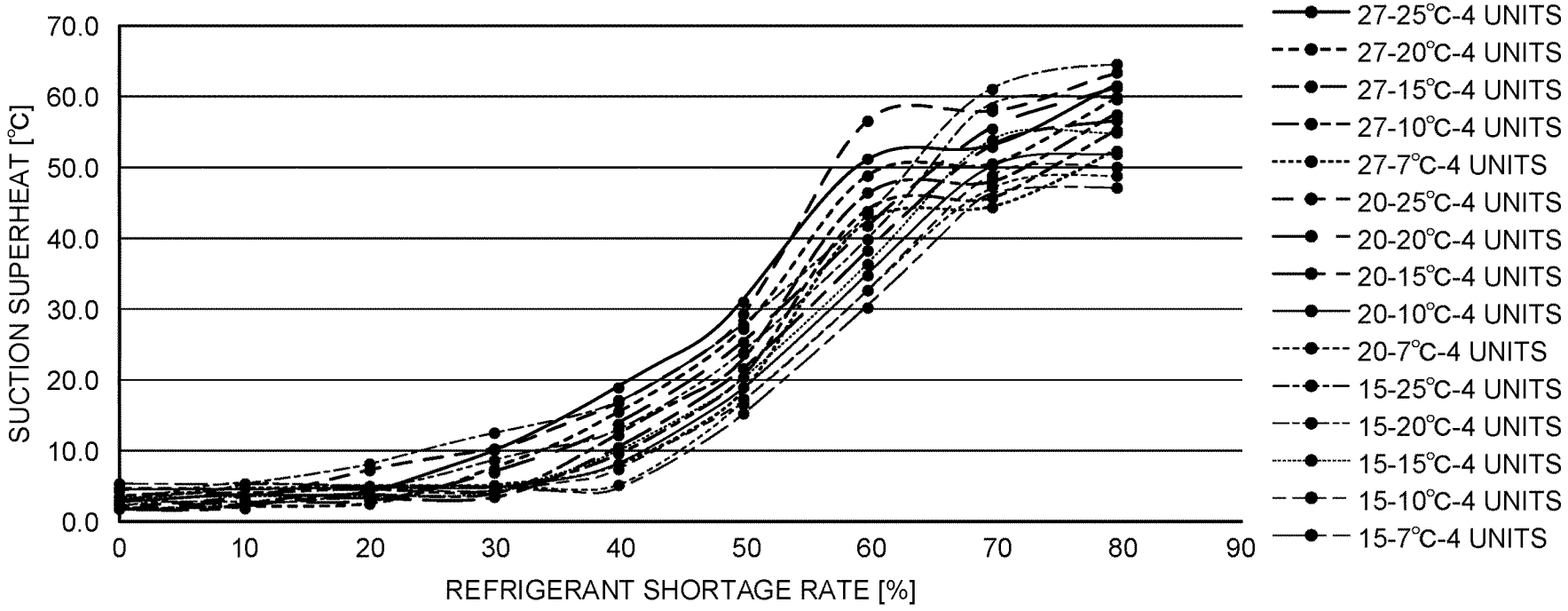
FIG. 15 is an explanatory diagram illustrating an example of a simulation result of a relationship between suction superheat and the refrigerant shortage rate.

FIG. 15 is an explanatory diagram illustrating an example of a simulation result of a relationship between the suction superheat and the refrigerant shortage rate. The suction superheat illustrated in FIG. 15 tends to increase with an increase in the refrigerant shortage rate, and the suction superheat largely increases when the refrigerant shortage rate exceeds 30%. In other words, in a region in which the refrigerant shortage rate at the time of heating operation is high (for example, 30%), the shortage of the refrigerant amount in the refrigerant circuit 6 largely affects the suction superheat. Meanwhile, in FIG. 15, a change of the suction superheat at the refrigerant shortage rate of less than 30% is moderate, and therefore, it is difficult to accurately estimate a lower refrigerant shortage rate by the suction superheat. Therefore, in the present embodiment, the suction superheat at the refrigerant shortage rate of less than 30% is not used for generation of regression equations.

Figure 16A:
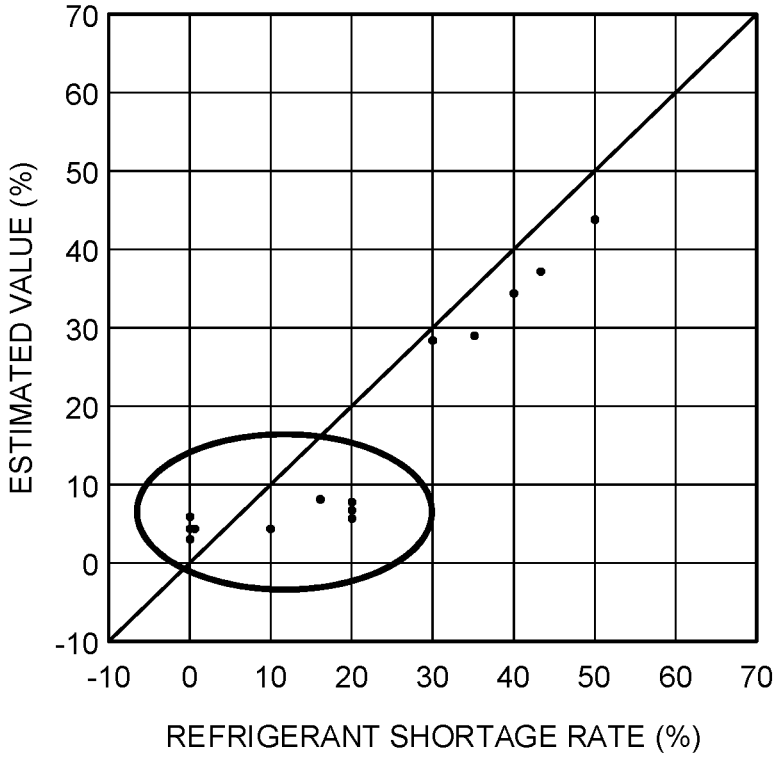
FIG. 16A is an explanatory diagram illustrating a relationship of accuracy of an estimation value at each refrigerant shortage rate of a third heater estimation model in which only the degree of opening of the outdoor unit expansion valve at the time of heating operation is used.

Accuracy of the estimated value at each of the refrigerant shortage rates in the third heater estimation model in a case where only the degree of opening of the outdoor unit expansion valve 14 at the time of heating operation is used as the operating state quantity of the first heater estimation model will be described below. FIG. 16A is an explanatory diagram illustrating a relationship of the accuracy of the estimated value at each of the refrigerant shortage rates in the third heater estimation model when only the degree of opening of the outdoor unit expansion valve 14 at the time of heating operation is used as the operating state quantity of the first heater estimation model.

For example, the correction R2 for the estimated value at the refrigerant shortage rate of 0% to 20% in the first heater estimation model in which only the degree of opening of the outdoor unit expansion valve 14 is used is 0.29. Meanwhile, it is indicated that the accuracy of the estimated value increases as the correction R2 approaches "1". If only the degree of opening of the outdoor unit expansion valve 14 at the time of heating operation is used as the operating state quantity of the first heater estimation model, in the third heater estimation model, as illustrated in FIG. 16A, the estimated value at each of the refrigerant shortage rates is likely to deviate from an ideal value X and the accuracy of the estimated value is reduced at the refrigerant shortage rate of 0% to 20%.

In contrast, if only the degree of supercooling of the indoor unit 3 at the time of heating operation is used as the operating state quantity of the first heater estimation model, the correction R2 of the estimated value at the refrigerant shortage rate of 0% to 20% in the first heater estimation model is 0.51. Therefore, the accuracy of the estimated value of the first heater estimation model increases with use of the degree of supercooling of the indoor unit 3 as compared to the case in which only the degree of opening of the outdoor unit expansion valve 14 is used. Further, if the rotation speed of the compressor 11 is used in addition to the degree of supercooling of the indoor unit 3 at the time of heating operation, the correction R2 of the estimated value at the refrigerant shortage rate of 0% to 20% in the first heater estimation model is 0.80, so that the accuracy of the estimated value further increases.

In the third heater estimation model 73F of the present embodiment at the time of heating operation, the degree of opening of the outdoor unit expansion valve 14 is used in addition to the degree of supercooling of the indoor unit 3 and the rotation speed of the compressor 11 as the operating state quantities of the first heater estimation model. In particular, the degree of supercooling of the indoor unit 3 largely changes at the refrigerant shortage rate of 0 to 20% as illustrated in FIG. 14. The third heater estimation model 73F is able to improve detection accuracy of the change of the refrigerant shortage rate by additionally taking into account the degree of supercooling of the indoor unit 3 as the operating state quantity when the refrigerant shortage rate is in a low range.

Figure 16B:
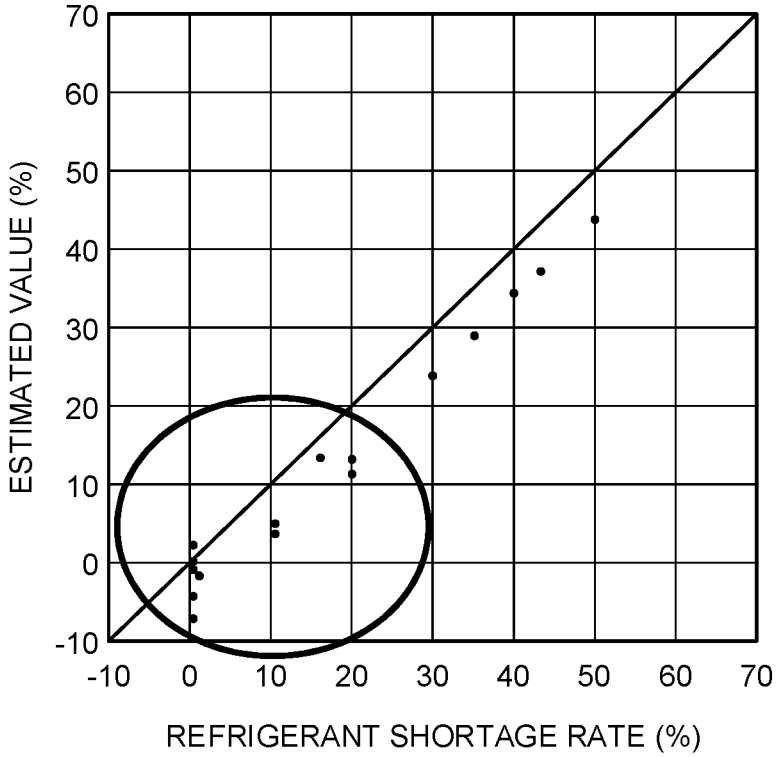
FIG. 16B is an explanatory diagram illustrating a relationship of accuracy of an estimation value at each refrigerant shortage rate of a third heater estimation model in which the degree of opening of the outdoor unit expansion valve, a degree of indoor supercooling, and the like at the time of heating operation are used.

The first heater estimation model 73D used in the present embodiment uses the degree of opening of the outdoor unit expansion valve 14 in addition to the degree of supercooling of the indoor unit 3 and the rotation speed of the compressor 11 as the operating state quantities, so that the correction R2 of the estimated value at the refrigerant shortage rate of 0% to 20% is set to 0.82. FIG. 16B is an explanatory diagram illustrating a relationship of the accuracy of the estimated value at each of the refrigerant shortage rates in the third heater estimation model 73F of the present embodiment. In the third heater estimation model 73F of the present embodiment, as illustrated in FIG. 16B, the estimated value at each of the refrigerant shortage rates is close to the ideal value X when the refrigerant shortage rate is 0% to 20%, and the estimation accuracy of the amount of refrigerant that remains in the refrigerant circuit 6 increases. Meanwhile, as described above, the degree of supercooling of the indoor unit 3 is affected by an external factor, such as outside temperature or indoor temperature, and therefore, if the operating state quantity (outdoor air temperature or indoor temperature) that reflects the external factor (the outside temperature, the indoor temperature, or the like) is included in the feature value, it is possible to improve the detection accuracy of the refrigerant shortage rate. If the outdoor air temperature and the indoor temperature are included as the operating state quantities in addition to the degree of supercooling of the indoor unit 3, the rotation speed of the compressor 11, and the degree of opening of the outdoor unit expansion valve 14, the correction R2 of the estimated value at the refrigerant shortage rate of 0% to 20% in the first heater estimation model 73D is set to 0.92.

Effects of First Embodiment

The air conditioner 1 of the first embodiment, when generating the fourth regression equation that is a refrigerant shortage rate estimation model in which the refrigerant shortage rate at the time of heating operation is in a low range, uses the degree of supercooling of the indoor unit 3. As a result, because the degree of supercooling of the indoor unit 3 for which the value largely changes in accordance with the refrigerant shortage rate when the refrigerant shortage rate is in a low range (for example, 0% to 20%) is used, it is possible to stably estimate a change of the refrigerant shortage rate at the time of heating operation even when the refrigerant shortage rate is in a low range.

The air conditioner 1, when generating the fifth regression equation that is a refrigerant shortage rate estimation mode in which the refrigerant shortage rate at the time of heating operation is in a high range, the model is generated by a regression analysis method by using the suction superheat of the compressor 11 and the degree of opening of the outdoor unit expansion valve 14 as the operating state quantities. As a result, in a range in which the refrigerant shortage rate is high, it is possible to stably estimate a change of the refrigerant shortage rate at the time of heating operation.

The air conditioner 1 estimates the refrigerant shortage rate at the time of cooling operation by using the cooler estimation model and a current operating state quantity at the time of cooling operation, and estimates the refrigerant shortage rate at the time of heating operation by using the heater estimation model and a current operating state quantity at the time of heating operation. As a result, with use of a different estimation model for each of the operating states, it is possible to estimate the refrigerant shortage rate with high accuracy.

The air conditioner 1 is able to estimate the refrigerant shortage rate with high accuracy at the time of heating operation by assigning the current operating state quantity to the third heater estimation model 73F in which the first heater estimation model 73D and the second heater estimation model 73E are connected by a sigmoid curve.

The first heater estimation model 73D estimates the refrigerant shortage rate by using the degree of opening of the outdoor unit expansion valve 14 and the degree of supercooling of the indoor unit 3 as the operating state quantities. As a result, the air conditioner 1 is able to estimate the refrigerant shortage rate with high accuracy at the time of heating operation.

The second heater estimation model 73E estimates the refrigerant shortage rate by using the suction superheat of the compressor 11 as the operating state quantity. As a result, the air conditioner 1 is able to estimate the refrigerant shortage rate with high accuracy at the time of heating operation.

The third heater estimation model 73F interpolates the estimation result of the first heater estimation model 73D and the estimation result of the second heater estimation model 73E by a sigmoid curve. As a result, it is possible to accurately estimate the refrigerant shortage rate in a range in which the refrigerant shortage rate at the time of heating operation is 0 to 70%.

In the multiple regression analysis process, the current operating state quantity (sensor value) that is subjected to the data filtering process and the data cleansing process is assigned to each of the regression equations of the estimation model. In the present embodiment, each of the regression equations of the estimation model is generated by using the feature value that is obtained by a simulation, and the feature value that is obtained by the simulation does not include abnormal values and values that are outstandingly large or small as compared to other values. In this manner, by assigning the operating state quantity that is subjected to the data filtering process and the data cleansing process to eliminate an outlier or an outstanding value to each of the regression equations of the estimation model that is generated by using the feature value that does not include abnormal values and outstanding values, it is possible to more accurately estimate the refrigerant shortage rate.

Meanwhile, in the embodiment as described above, the example has been described in which the simulation result of each of the operating state quantities is obtained at the design stage of the air conditioner 1, and an estimation model that is obtained by causing a certain terminal, such as a server, with a learning function to learn the simulation result is stored in the control circuit 70 in advance. Alternatively, it may be possible to provide the server 120 that is connected to the air conditioner 1 by a communication network 110, and the server 120 may generate the first to the sixth regression equations and transmit the first to the sixth regression equations to the air conditioner 1. This embodiment will be described below.

Second Embodiment

Configuration of Air Conditioning System

Figure 17:
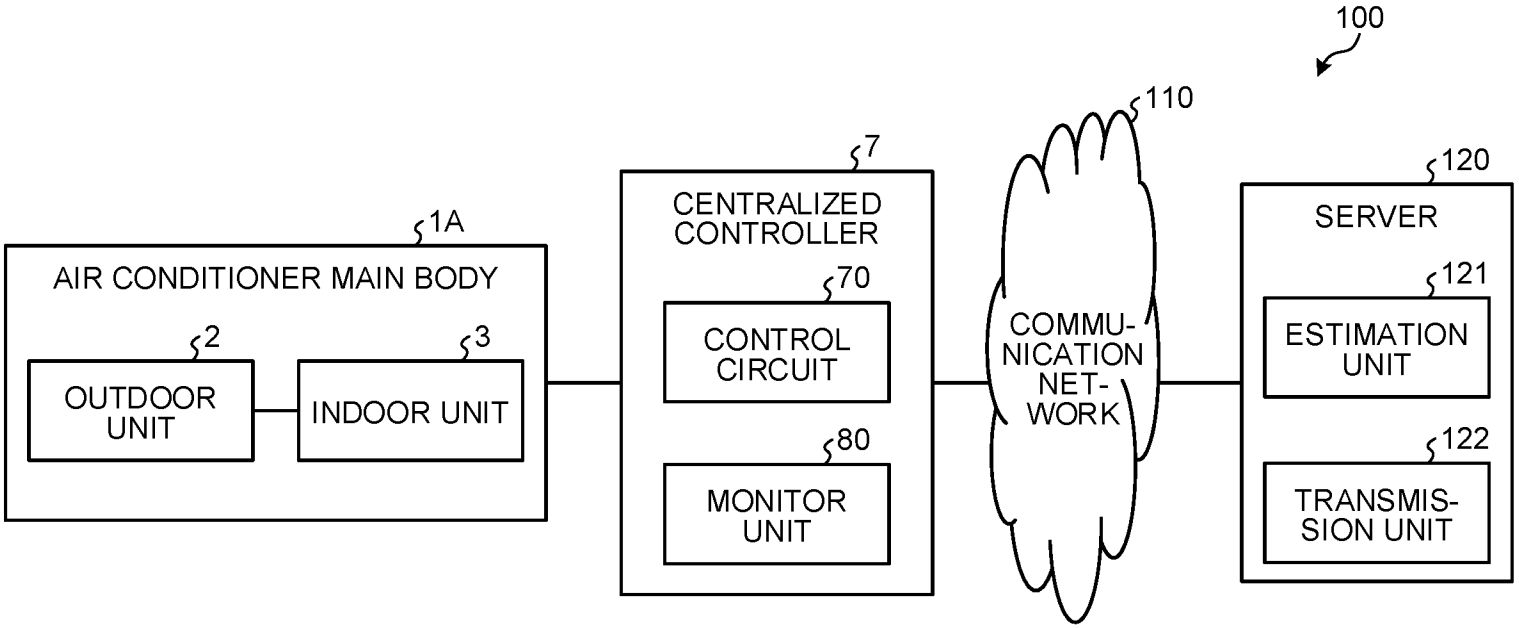
FIG. 17 is an explanatory diagram illustrating an example of an air conditioning system of a second embodiment.

FIG. 17 is an explanatory diagram illustrating an example of an air conditioning system 100 of a second embodiment. Meanwhile, the same components as those of the air conditioner 1 of the first embodiment will be denoted by the same reference symbols, and explanation of the same configurations and same operation will be omitted. The air conditioning system 100 illustrated in FIG. 17 includes the air conditioner main body 1A, the centralized controller 7, the communication network 110, and the server 120. The air conditioner main body 1A includes the outdoor unit 2 that includes the compressor 11, the outdoor heat exchanger 13, and the outdoor unit expansion valve 14 and the indoor unit 3 that includes the indoor heat exchanger 51. The air conditioner main body 1A includes the refrigerant circuit 6 in which the outdoor unit 2 and the indoor unit 3 are connected to each other by the refrigerant pipes, such as the liquid pipe 4 and the gas pipe 5, and a predetermined amount of refrigerant is stored in the refrigerant circuit 6. The centralized controller 7 connects the air conditioner main body 1A and the communication network 110 by communication. The centralized controller 7 includes a monitor unit 80 that displays a state of the air conditioner main body 1A including the outdoor unit 2 and the indoor unit 3, and a control circuit 70 that controls the entire air conditioner main body 1A.

The server 120 includes an estimation unit 121 and a transmission unit 122. The estimation unit 121 estimates the refrigerant shortage rate by using an estimation model that is generated by a multiple regression analysis method by using the operating state quantity that is related to estimation of a refrigerant shortage rate of the refrigerant that is stored in the refrigerant circuit 6. Meanwhile, the estimation model includes, for example, the first cooler estimation model 73A, the second cooler estimation model 73B, the third cooler estimation model 73C, the first heater estimation model 73D, the second heater estimation model 73E, and the third heater estimation model 73F that are described in the first embodiment. The transmission unit 122 transmits an estimation result that is estimated by the estimation unit 121 to the centralized controller 7 via the communication network 110. The control circuit 70 in the centralized controller 7 displays the refrigerant shortage rate of the refrigerant circuit 6 of the air conditioner 1 for a user by using the received estimation result.

Effects of Second Embodiment

The server 120 of the second embodiment estimates the refrigerant shortage rate by using the current operating state quantity. As a result, the user is able to confirm the refrigerant shortage rate of the air conditioner 1 via the centralized controller 7.

Furthermore, in the present embodiment, the case has been described in which the relative refrigerant amount is estimated as an amount that represents the amount of refrigerant that remains in the refrigerant circuit 6. Specifically, the case has been described in which the refrigerant shortage rate that is a rate of the amount of refrigerant that has leaked to the outside from the refrigerant circuit 6 to a storage amount (initial value) at the time of storing the refrigerant is estimated and provided. However, the present invention is not limited to this example, and it may be possible to multiply the estimated refrigerant shortage rate by the initial value and provides the amount of the refrigerant that has leaked to the outside from the refrigerant circuit 6. Further, it may be possible to estimate an absolute amount of the refrigerant that has leaked to the outside from the refrigerant circuit 6 or an absolute amount of refrigerant that remains in the refrigerant circuit 6. When estimating the absolute amount of the refrigerant that has leaked to the outside from the refrigerant circuit 6 or the absolute amount of refrigerant that remains in the refrigerant circuit 6, it is sufficient to take into account volumes of the outdoor heat exchanger 13 and each of the indoor heat exchangers 51 and a volume of the liquid pipe 4 in addition to each of the operating state quantities as described above.

Modification

Meanwhile, in the present embodiment, the case has been described in which, for example, the estimation result of the first heater estimation model 73D and the estimation result of the second heater estimation model 73E are interpolated by the sigmoid coefficient, but embodiments are not limited to the sigmoid coefficient; for example, it may be possible to use a different interpolation method, such as linear interpolation, and appropriate modification is applicable.

Meanwhile, in the present embodiment, the estimation model that is generated in advance is used. However, the estimation model may be generated by the server 120. For example, the server 120 may generate the estimation model that estimates the refrigerant shortage rate by using a multiple regression analysis method using the operating state quantity that is related to estimation of the refrigerant shortage rate of the refrigerant that is stored in the refrigerant circuit 6 and a measurement result of a measurement device that measures the refrigerant amount. Further, in the present embodiment, the case has been described in which each of the estimation models is generated by using the multiple regression analysis method, but it may be possible to generate the estimation models by using Support Vector Regression (SVR), a Neural Network (NN), of the like of a machine learning method that is able to perform a general regression analysis method. In this case, when selecting the feature value, it is sufficient to use a general method (a Forward Feature Selection method, a Backward feature Elimination, or the like) for selecting a feature value such that the accuracy of the estimation models is improved, instead of the P value or the correction R2 used in the multiple regression analysis method.

Meanwhile, the example has been described in which the control unit 74 that performs the sensor value editing process determines whether "sensor value is changed" is present if a plurality of sensor values are present at around the representative time, and if "sensor value is changed" is present, the sensor value indicated by "sensor value is changed" at the earliest time is determined as the representative sensor value. However, embodiments are not limited to "sensor value is changed" at the earliest time, but, for example, an average value of the sensor values indicated by "sensor value is changed" or a "sensor value" at the latest time, and appropriate change is applicable.

The case has been described in which when each of the sensor values at the detection times around the representative time are not acquired, the control unit 74 determines the representative sensor value at the previous representative time as the representative sensor value of the representative time. However, the control unit 74 need not always use the representative sensor value at the previous representative time, but may use for example, a previous sensor value indicated by "sensor value is changed", and an appropriate change is applicable. Furthermore, the components illustrated in the drawings need not necessarily be physically configured in the manner illustrated in the drawings. In other words, specific forms of distribution and integration of the components are not limited to those illustrated in the drawings, and all or part of the components may be functionally or physically distributed or integrated in arbitrary units depending on various loads or use conditions.

Moreover, all or part of various processing functions implemented by each of the apparatuses may be implemented by a central processing unit (CPU) (or a microcomputer, such as a micro processing unit (MPU) or a micro controller unit (MCU)). Furthermore, all or part of each of the various processing functions may be realized by a CPU and a program analyzed and executed by the CPU, or may be realized by hardware using wired logic.

Moreover, in each of the embodiments as described above, the refrigerant shortage rate that is the relative refrigerant amount is used as an index that represents the amount of refrigerant that remains in the refrigerant circuit 6, for example. The refrigerant shortage rate indicates a reduction rate of refrigerant from a prescribed amount based on the assumption that 100% of a refrigerant filling rate indicates a state in which the prescribed amount of refrigerant is stored in the refrigerant circuit 6. However, it may be possible to use the refrigerant filling rate instead of the refrigerant reduction rate, as the index that represents the amount of refrigerant that remains in the refrigerant circuit 6. Furthermore, a reference amount (prescribed amount) for representing a shortage rate or a filling rate of refrigerant is assumed as a refrigerant amount that is determined in advance, but it may be possible to alternatively adopt an amount of refrigerant that is actually stored in the refrigerant circuit as the reference amount (prescribed amount). In this case, for example, even if the amount of refrigerant that is actually stored in the refrigerant circuit 6 is smaller (or larger) than the prescribed amount that is determined in advance, it is possible to adopt the refrigerant amount as 100%. In this manner, by adopting the amount of the actually stored refrigerant as the reference amount, it becomes possible to more accurately estimate the refrigerant shortage rate for each of the refrigerant circuits. Moreover, it may be possible to adopt a refrigerant amount that is an absolute index as the index that represents the amount of refrigerant that remains in the refrigerant circuit 6, instead of a relative index (percentage).

REFERENCE SIGNS LIST

1 air conditioner
2 outdoor unit
3 indoor unit
4 liquid pipe
5 gas pipe
11 compressor
12 four-way valve
13 outdoor heat exchanger
14 outdoor unit expansion valve
19 outdoor unit controller
19A outdoor-side detection unit
19B outdoor-side storage unit
19C outdoor-side control unit
51 indoor heat exchanger
65 indoor unit controller
65A indoor-side detection unit
65B indoor-side storage unit
65C indoor-side control unit
71 acquisition unit
73D first heater estimation model
73E second heater estimation model
73F third heater estimation model
74 control unit
74A estimation unit

The invention claimed is:

1. An air conditioner comprising:

an outdoor unit that includes a compressor, an outdoor heat exchanger, and an expansion valve;

an indoor unit that includes an indoor heat exchanger;

a refrigerant circuit in which the outdoor unit and the indoor unit are connected to each other by a refrigerant pipe, and performs at least a heating operation in which the indoor heat exchanger functions as a condenser for a refrigerant that is compressed by the compressor and the outdoor heat exchanger functions as an evaporator for a refrigerant that is condensed by the indoor heat exchanger;

a first memory; and a first processing circuitry coupled to the first memory and configured to:

estimate an amount of refrigerant that remains in the refrigerant circuit by using an operating state quantity of the air conditioner in at least the heating operation, wherein the estimating includes a plurality of different estimation models that correspond to ranges of the amount of refrigerant that remains in the refrigerant circuit, and one of the estimation models uses, as the operating state quantity, a first degree of supercooling of refrigerant at an outlet of the indoor heat exchanger.

2. The air conditioner according to claim 1, wherein an estimation model that corresponds to a first range in which the amount of refrigerant that remains in the refrigerant circuit is large among the plurality of estimation models serves as a first estimation model, an estimation model that corresponds to a second range in which the amount of refrigerant that remains in the refrigerant circuit is small among the plurality of estimation models serves as a second estimation model, and the first estimation model uses the first degree of supercooling of the refrigerant at the outlet of the indoor heat exchanger as the operating state quantity.

3. The air conditioner according to claim 2, wherein the estimating includes a third estimation model that includes the first estimation model and the second estimation model.

4. The air conditioner according to claim 1, wherein a plurality of indoor units are installed, and the estimating, when indoor heat exchangers of at least two of the plurality of indoor units function as condensers for refrigerant that is compressed by the compressor, estimates a refrigerant amount by the estimation model by using the first degree of supercooling of the refrigerant at outlets of the indoor heat exchangers that function as the condensers.

5. The air conditioner according to claim 4, wherein the estimating estimates the refrigerant amount by using a second degree of supercooling that is based on an average value of refrigerant temperature at the outlet of the indoor heat exchanger of each of the at least two indoor units.

6. The air conditioner according to claim 1, wherein the indoor unit includes a second memory; and a second processing circuitry coupled to the second memory and configured to:

control operation of each of an indoor detection unit, an indoor control unit, and an indoor storage unit that are located in the indoor unit;

detect an indoor-side operating state quantity that is an operating state quantity at a side of the indoor unit among operating state quantities; and store in the second memory an indoor-side detection result of the detecting of the indoor-side operating state quantity, and the outdoor unit includes a third memory; and a third processing circuitry coupled to the third memory and configured to:

control operation of each of an outdoor detection unit, an outdoor control unit, and an outdoor storage unit that are located in the outdoor unit;

detect an outdoor-side operating state quantity that is an operating state quantity at a side of the outdoor unit among the operating state quantities; and store in the third memory an outdoor-side detection result of the detecting of the outdoor-side operating state quantity, the control operation of each of the indoor detection unit, the indoor control unit, and the indoor storage unit stores the indoor-side detection result in the second memory in association with a first detection time, and the control operation of each of the outdoor detection unit, the outdoor control unit, and the outdoor storage unit stores the outdoor-side detection result in the third memory in association with a second detection time.

7. The air conditioner according to claim 6, further including:

a centralized controller that displays states of the indoor unit and the outdoor unit, and includes:

a fourth memory; and a fourth processing circuitry coupled to the fourth memory and configured to:

store in the fourth memory the indoor-side detection result that is associated with the first detection time and the outdoor-side detection result that is associated with the second detection time, and store, when the first detection time of the indoor-side detection result and the second detection time of the outdoor-side detection result fall in a predetermined range, the indoor-side detection result and the outdoor-side detection result in the fourth memory in association with a new time.

8. The air conditioner according to claim 6, wherein the detecting of the indoor-side operating state quantity includes detecting, via a first sensor, as the indoor-side detection result, temperature of a refrigerant at the outlet of the indoor heat exchanger, the detecting of the outdoor-side operating state quantity includes detecting, via a second sensor, as the outdoor-side detection result, high-pressure saturation temperature of the outdoor heat exchanger, and the estimating estimates the refrigerant amount by using a third degree of supercooling that is calculated by using the indoor-side detection result and the outdoor-side detection result when the first detection time of the indoor-side detection result and the second detection time of the outdoor-side detection result fall in a predetermined range.

9. The air conditioner according to claim 8, wherein when the indoor heat exchangers of at least two or more of the indoor units function among the indoor units as condensers for the refrigerant that is compressed by the compressor, the estimating estimates the refrigerant amount by using a fourth degree of supercooling that is based on an average value of detection results that are detected by the first sensors of the at least two indoor units.

10. The air conditioner according to claim 1, wherein the estimation model is an estimation model that estimates a refrigerant shortage rate that indicates a rate of a refrigerant reduced from the refrigerant circuit, as the amount of refrigerant that remains in the refrigerant circuit.

11. An air conditioning system comprising:

an air conditioner that includes:

an outdoor unit that includes a compressor, an outdoor heat exchanger, and an expansion valve;

an indoor unit that includes an indoor heat exchanger;

a refrigerant circuit in which the outdoor unit and the indoor unit are connected to each other by a refrigerant pipe, and performs at least a heating operation in which the indoor heat exchanger functions as a condenser for a refrigerant that is compressed by the compressor and the outdoor heat exchanger functions as an evaporator for a refrigerant that is condensed by the indoor heat exchanger; and a server that is connected to air conditioner by communication, wherein the server includes:

a first memory; and a first processing circuitry coupled to the first memory and configured to:

estimate an amount of refrigerant that remains in the refrigerant circuit by using an operating state quantity of the air conditioner in at least the heating operation, the estimating includes a plurality of different estimation models that correspond to ranges of the amount of refrigerant that remains in the refrigerant circuit, and one of the estimation models uses, as the operating state quantity, a degree of supercooling of refrigerant at an outlet of the indoor heat exchanger.

12. The air conditioning system according to claim 11, wherein an estimation model that corresponds to a first range in which the amount of refrigerant that remains in the refrigerant circuit is large among the plurality of estimation models serves as a first estimation model, an estimation model that corresponds to a second range in which the amount of refrigerant that remains in the refrigerant circuit is small among the plurality of estimation models serves as a second estimation model, and the first estimation model uses the first degree of supercooling of the refrigerant at the outlet of the indoor heat exchanger as the operating state quantity.

13. The air conditioning system according to claim 12, wherein the estimating includes a third estimation model that includes the first estimation model and the second estimation model.

14. The air conditioning system according to claim 11, wherein a plurality of indoor units are installed, and the estimating, when indoor heat exchangers of at least two of the plurality of indoor units function as condensers for refrigerant that is compressed by the compressor, estimates a refrigerant amount by the estimation model by using the first degree of supercooling of the refrigerant at outlets of the indoor heat exchangers that function as the condensers.

15. The air conditioning system according to claim 14, the estimating estimates the refrigerant amount by using a second degree of supercooling that is based on an average value of refrigerant temperature at the outlet of the indoor heat exchanger of each of the at least two indoor units.

16. The air conditioning system according to claim 11, further including:

a centralized controller that displays states of the indoor unit and the outdoor unit, wherein the air conditioner and the server are connected to each other by communication via the centralized controller.

17. The air conditioning system according to claim 11, wherein the indoor unit includes a second memory; and a second processing circuitry coupled to the second memory and configured to:

control operation of each of an indoor detection unit, an indoor control unit, and an indoor storage unit that are located in the indoor unit;

detect an indoor-side operating state quantity that is an operating state quantity at a side of the indoor unit among operating state quantities; and store in the second memory an indoor-side detection result of the detecting of the indoor-side operating state quantity, and the outdoor unit includes a third memory; and third processing circuitry coupled to the third memory and configured to:

control operation of each of an outdoor detection unit, an outdoor control unit, and an outdoor storage unit that are located in the outdoor unit;

detect an outdoor-side operating state quantity that is an operating state quantity at a side of the outdoor unit among the operating state quantities; and store in the third memory an outdoor-side detection result of the detecting of the outdoor-side operating state quantity, the control operation of each of the indoor detection unit, the indoor control unit, and the indoor storage unit stores the indoor-side detection result in the second memory in association with a first detection time, and the control operation of each of the outdoor detection unit, the outdoor control unit, and the outdoor storage unit stores the outdoor-side detection result in the third memory in association with a second detection time.

18. The air conditioning system according to claim 17, further including:

a centralized controller that displays states of the indoor unit and the outdoor unit, wherein the centralized controller includes:

a fourth memory; and a fourth processing circuitry coupled to the fourth memory and configured to:

store in the fourth memory the indoor-side detection result that is associated with the first detection time and the outdoor-side detection result that is associated with the second detection time, and store, when the first detection time of the indoor-side detection result and the second detection time of the outdoor-side detection result fall in a predetermined range, the indoor-side detection result in the indoor storage unit and the outdoor-side detection result in the outdoor storage unit in association with a new time.

19. The air conditioning system according to claim 17, wherein the detecting of the indoor-side operating state quantity includes detecting, via a first sensor, as the indoor-side detection result, temperature of a refrigerant at the outlet of the indoor heat exchanger, the detecting of the outdoor-side operating state quantity includes detecting, via a second sensor, as the outdoor-side detection result, high-pressure saturation temperature of the outdoor heat exchanger, and the estimating estimates the refrigerant amount by using a third degree of supercooling that is calculated by using the indoor-side detection result and the outdoor-side detection result when the first detection time of the indoor-side detection result and the second detection time of the outdoor-side detection result fall in a predetermined range.

20. The air conditioning system according to claim 19, wherein when the indoor heat exchangers of at least two or more of the indoor units function among the indoor units as condensers for the refrigerant that is compressed by the compressor, the estimating estimates the refrigerant amount by using a fourth degree of supercooling that is based on an average value of detection results that are detected by the first sensors of the at least two indoor units.

21. The air conditioning system according to claim 11, wherein an estimation model from among the plurality of different estimation models estimates a refrigerant shortage rate that indicates a rate of a refrigerant that has leaked from the refrigerant circuit, as the amount of refrigerant that remains in the refrigerant circuit.

* * * * *